US011431119B2

(12) United States Patent
Obata et al.

(10) Patent No.: US 11,431,119 B2
(45) Date of Patent: Aug. 30, 2022

(54) FLOATING CONNECTOR

(71) Applicant: JAPAN AVIATION ELECTRONICS INDUSTRY, LIMITED, Tokyo (JP)

(72) Inventors: Yusuke Obata, Tokyo (JP); Takashi Tokunaga, Tokyo (JP); Kazuki Takikawa, Tokyo (JP); Kiichi Hori, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/220,023

(22) Filed: Apr. 1, 2021

(65) Prior Publication Data

US 2021/0376509 A1 Dec. 2, 2021

(30) Foreign Application Priority Data

May 28, 2020 (JP) ..... JP2020-093259

(51) Int. Cl.

| | |
|---|---|
| ***H01R 12/91*** | (2011.01) |
| ***H01R 12/71*** | (2011.01) |
| ***H01R 13/631*** | (2006.01) |
| ***H01R 43/16*** | (2006.01) |
| *H01R 13/11* | (2006.01) |

(Continued)

(52) U.S. Cl.

CPC ..... *H01R 12/91* (2013.01); *H01R 12/71* (2013.01); *H01R 13/6315* (2013.01); *H01R 43/16* (2013.01); *H01R 12/57* (2013.01); *H01R 12/73* (2013.01); *H01R 13/02* (2013.01);

(Continued)

(58) Field of Classification Search

CPC .... H01R 12/91; H01R 12/71; H01R 13/6315; H01R 43/16; H01R 13/11; H01R 13/6474; H01R 12/57; H01R 12/73; H01R 13/41; H01R 13/02; H01R 12/716; H01R 13/502

See application file for complete search history.

(56) References Cited

U.S. PATENT DOCUMENTS

| | | | |
|---|---|---|---|
| 10,128,614 | B2 | 11/2018 | Suzuki et al. |
| 10,680,386 | B2 | 6/2020 | Kakino et al. |

(Continued)

FOREIGN PATENT DOCUMENTS

| | | | |
|---|---|---|---|
| JP | 2012164525 | A | 8/2012 |
| JP | 2017157304 | A | 9/2017 |

(Continued)

OTHER PUBLICATIONS

Extended European Search Report (EESR) dated Dec. 9, 2021, issued in counterpart European Application No. 21165472.8.

*Primary Examiner* — Abdullah A Riyami
*Assistant Examiner* — Justin M Kratt
(74) *Attorney, Agent, or Firm* — Holtz, Holtz & Volek PC

(57) ABSTRACT

A floating connector is provided with a plurality of contacts, at least one stub member and a movable housing. The movable housing has a first holding portion and a second holding portion. The first holding portion holds first held portions of the contacts, and the second holding portion holds a second held portion of the stub member. The at least one stub member corresponds to at least one of the contacts in one-to-one correspondence. A stub contact point is always pressed against a coupling portion of the contact corresponding to the stub member even when the movable housing is moved within a predetermined range.

16 Claims, 22 Drawing Sheets

(51) Int. Cl.

| | |
|---|---|
| *H01R 12/73* | (2011.01) |
| *H01R 13/41* | (2006.01) |
| *H01R 13/502* | (2006.01) |
| *H01R 13/02* | (2006.01) |
| *H01R 12/57* | (2011.01) |
| *H01R 13/6474* | (2011.01) |

(52) U.S. Cl.
CPC ..... *H01R 13/11* (2013.01); *H01R 13/41* (2013.01); *H01R 13/502* (2013.01); *H01R 13/6474* (2013.01)

(56) References Cited

U.S. PATENT DOCUMENTS

| | | | | |
|---|---|---|---|---|
| 11,296,447 | B2 * | 4/2022 | Horii ..... | H01R 13/639 |
| 2020/0313327 | A1 | 10/2020 | Morita et al. | |

FOREIGN PATENT DOCUMENTS

| | | | |
|---|---|---|---|
| JP | 2018133309 | A | 8/2018 |
| JP | 2019071191 | A | 5/2019 |
| JP | 2019079727 | A | 5/2019 |
| JP | 2019079787 | A | 5/2019 |
| JP | 2019114565 | A | 7/2019 |
| JP | 2019114566 | A | 7/2019 |
| JP | 2019125583 | A | 7/2019 |
| JP | 2019125584 | A | 7/2019 |
| JP | 6598912 | B2 | 10/2019 |
| JP | 2019169370 | A | 10/2019 |

* cited by examiner

FLOATING CONNECTOR

CROSS REFERENCE TO RELATED APPLICATIONS

This application is based on and claims priority under 35 U.S.C. § 119 to Japanese Patent Application No. JP2020-093259 filed May 28, 2020, the contents of which are incorporated herein in their entirety by reference.

BACKGROUND OF THE INVENTION

This invention relates to a floating connector.

An example of a floating connector is disclosed in JP2019-114565A (Patent Document 1). As shown in FIG. 29, a floating connector 90 of Patent Document 1 is provided with a plurality of contacts 92, a first insulator (or a fixed housing) 94 and a second insulator (or a movable housing) 96. Each of the contacts 92 is held by the first insulator 94 and held by the second insulator 96. The contact 92 is resiliently deformable in part. The second insulator 96 is movable with respect to the first insulator 94 by using resilient deformation of the contacts 92. Accordingly, when the floating connector 90 and a mating connector (not shown) are mated with each other, a misalignment between the floating connector 90 and the mating connector in a plane direction perpendicular to a mating direction can be compensated.

SUMMARY OF THE INVENTION

In general, a length of a contact of a floating connector tends to be long in comparison with that of a contact of a general connector. This is for giving resilience to the contact to allow a movable housing to be moved with respect to a fixed housing and to secure a predetermined movable range for the movable housing. However, a long contact is undesirable for signal transmission, especially high-speed signal transmission, because it has a high impedance. Therefore, in the floating connector 90 of Patent Document 1, a wide adjustment portion 98 is provided to the contact 92 to reduce an impedance of the contact 92.

However, the wide adjustment portion 98 is hard to be resiliently deformed. Accordingly, when the contact 92 is resiliently deformed, a stress concentrates at a narrow part near the wide adjustment portion 98. As a result, the floating connector 90 of Patent Document 1 has a problem that the contact 92 may be damaged due to stress concentration. In addition, the floating connector 90 has another problem that a size of the contact 92 may be enlarged since the contact 92 has the wide adjustment portion 98.

It is therefore an object of the present invention to provide a floating connector in which an impedance is reduced without providing a wide adjustment portion.

A floating connector of the present invention employs a structure which reduces an impedance of a transmission path by providing a stub to the transmission path.

In detail, by providing at least one stub member which corresponds to at least one contact in one-to-one correspondence, an impedance of the contact is reduced. The stub member has a structure which is always in contact with the contact even when the contact is resiliently deformed.

In more detail, one aspect of the present invention provides a floating connector which is mounted on a substrate when used and which is mateable with and removable from a mating connector having a mating contact portion along an up-down direction. The floating connector comprises a plurality of contacts, at least one stub member and a movable housing. The movable housing has a first holding portion and a second holding portion. Each of the contacts has a fixed portion to be fixed to the substrate, a first held portion held by the first holding portion, a coupling portion coupling the fixed portion and the first held portion with each other, an extension portion extending upward from the first held portion and a contact portion supported by the extension portion. The contact portion comes into contact with the mating contact portion when the floating connector is mated with the mating connector. The coupling portion is resiliently deformable and thereby the movable housing is movable within a predetermined range in a plane perpendicular to the up-down direction. the at least one stub member corresponds to at least one of the contacts in one-to-one correspondence. The stub member has a second held portion held by the second holding portion, a supporting portion extending from the second held portion and a stub contact point supported by the supporting portion. The stub contact point is always pressed against the coupling portion of the contact corresponding to the stub member even when the movable housing is moved within the predetermined range.

Another aspect of the present invention provides a floating connector which is mounted on a substrate when use and which is mateable with and removable from a mating connector having a mating contact portion. The floating connector comprises a plurality of contacts, at least one stub member, a fixed housing and a movable housing. The movable housing has a first holding portion. The fixed housing has a second holding portion and a third holding portion. Each of the contacts has a fixed portion to be fixed to the substrate, a third held portion held by the third holding portion, a first held portion held by the first holding portion, a deformable portion coupling the first held portion and the third held portion with each other, an extension portion extending upward from the first held portion and a contact portion supported by the extension portion. The contact portion comes into contact with the mating contact portion when the floating connector is mated with the mating connector. The deformable portion is deformable and thereby the movable housing is movable within a predetermined range in a plane perpendicular to the up-down direction. The at least one stub member corresponds to at least one of the contacts in one-to-one correspondence. The stub member has a second held portion held by the second holding portion, a supporting portion extending from the second held portion and a stub contact point supported by the supporting portion. The stub contact point is always pressed against the deformable portion of the contact corresponding to the stub member even when the movable housing is moved within the predetermined range.

The floating connector of the present invention is provided with the plurality of the contacts and the at least one stub member corresponding to the at least one of the contacts in one-to-one correspondence. The stub member has the stub contact point. The stub contact point is always pressed against the contact corresponding to the stub member even when the movable housing is moved within the predetermined range. With this structure, an impedance of the contact can be reduced without providing a wide adjustment portion to the contact.

An appreciation of the objectives of the present invention and a more complete understanding of its structure may be had by studying the following description of the preferred embodiment and by referring to the accompanying drawings.

Figure 1:
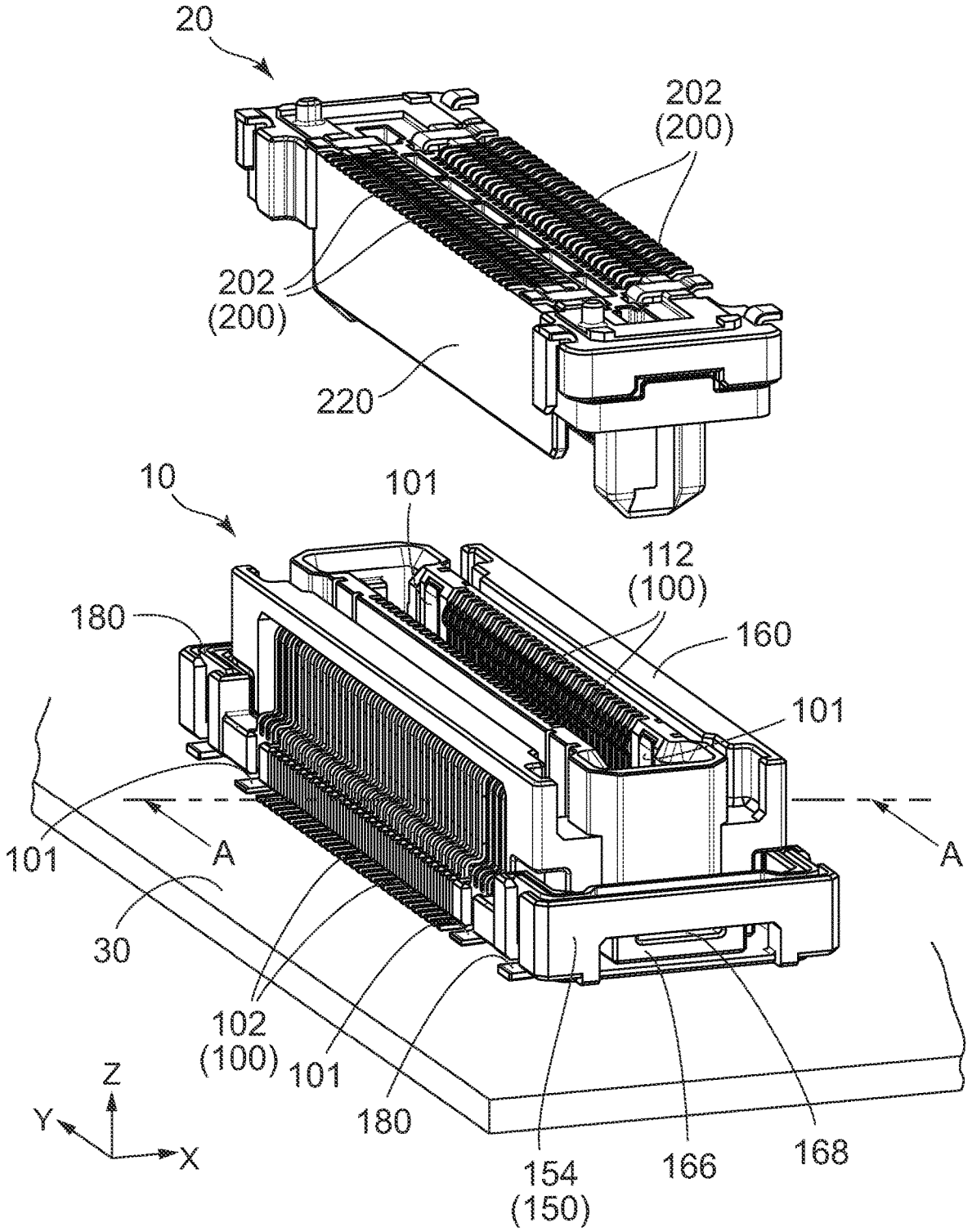
FIG. 1 is a perspective view showing a floating connector according to a first embodiment of the present invention and a mating connector mateable with the floating connector. The floating connector and the mating connector are not mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
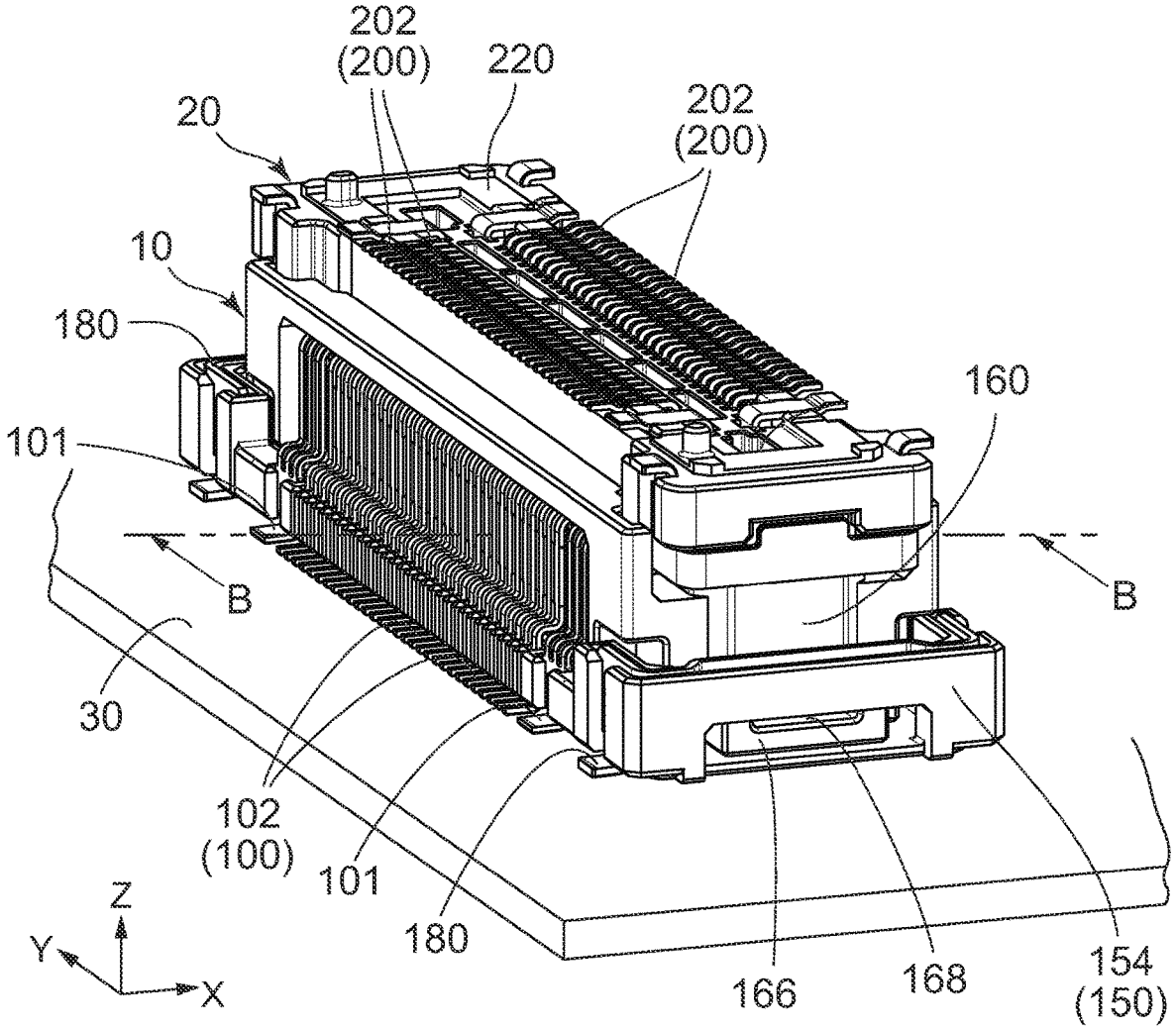
FIG. 2 is a perspective view showing the floating connector and the mating connector of FIG. 1. The floating connector and the mating connector are mated with each other.

Referring to FIGS. 1 and 2, a floating connector 10 according to a first embodiment of the present invention is mounted on a substrate 30 when used. The floating connector 10 is mateable with and removable from a mating connector 20 along a mating direction perpendicular to the substrate 30. In the present embodiment, the mating direction is an up-down direction or a Z-direction. A positive Z-direction is directed upward while a negative Z-direction is directed downward.

Figure 3:
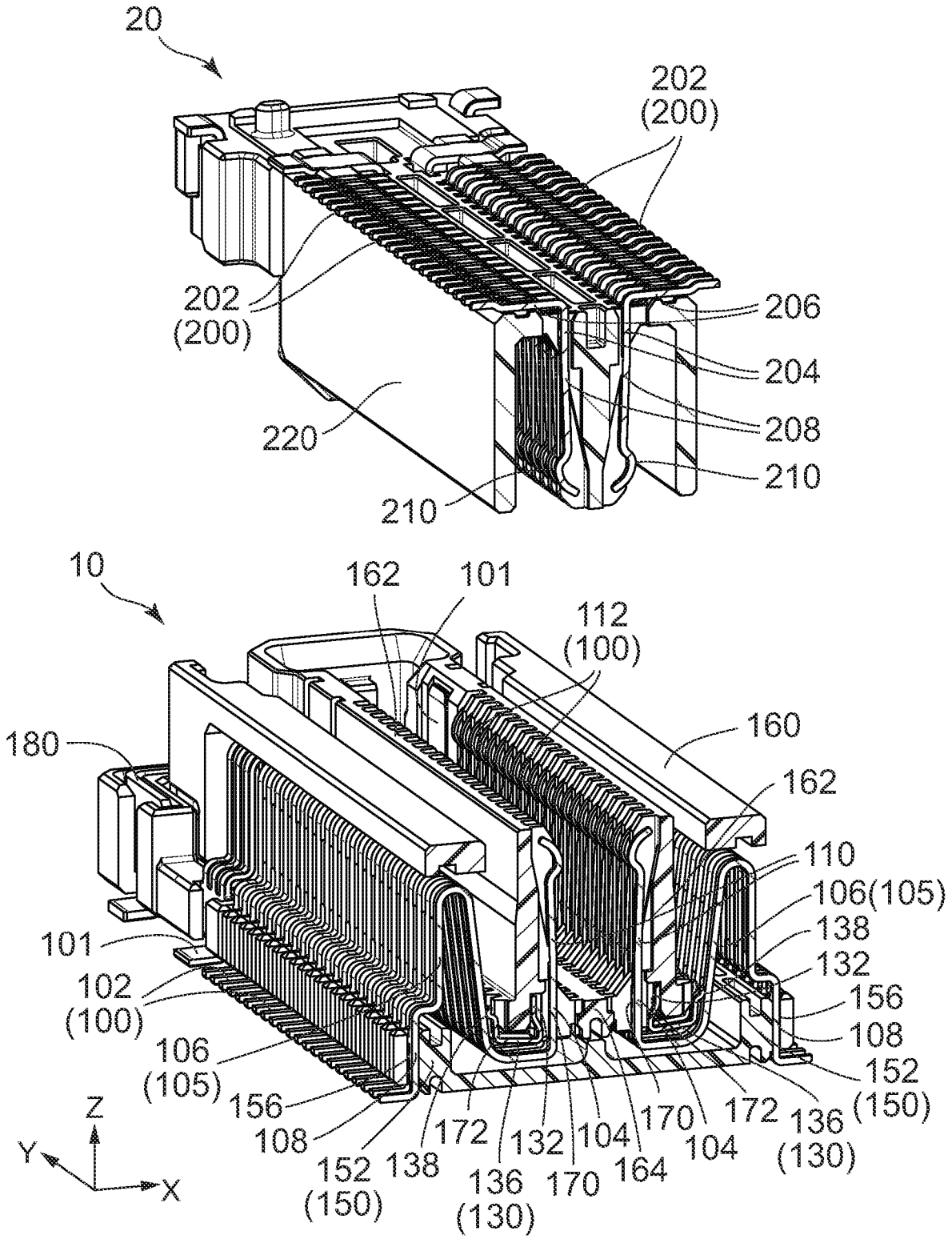
FIG. 3 is a perspective, cross-sectional view showing the floating connector and the mating connector of FIG. 1, taken along line A-A.
Figure 4:
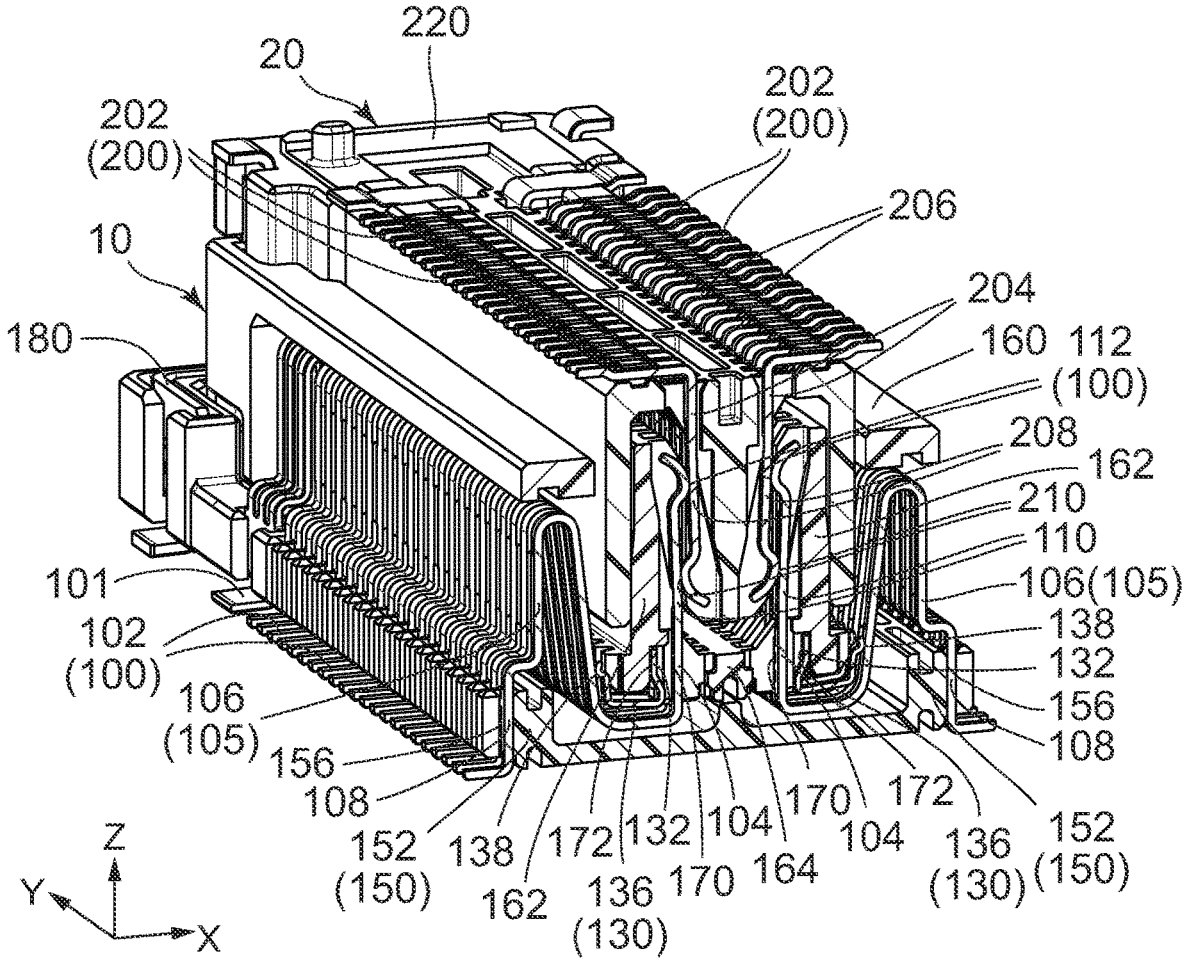
FIG. 4 is a perspective, cross-sectional view showing the floating connector and the mating connector of FIG. 2, taken along line B-B.

As shown in FIGS. 3 and 4, the mating connector 20 is provided with a plurality of mating contacts 200 and a mating housing 220. The mating contacts 200 are made of metal, and the mating housing 220 is made of insulating resin. The mating housing 220 has a shape long in a pitch direction perpendicular to the up-down direction. The mating contacts 200 are arranged in two rows along the pitch direction and held by the mating housing 220. In the present embodiment, the pitch direction is a Y-direction. However, the present invention is not limited thereto. The mating contacts 200 may be arranged in one row.

As understood from FIGS. 3 and 4, the two rows of the mating contacts 200 are apart from each other in a lateral direction perpendicular to both of the up-down direction and the pitch direction. In the present embodiment, the lateral direction is an X-direction. Hereinafter, one of the two rows of the mating contacts 200 that is located on the positive X-side will be referred to as a first row while the other row located on the negative X-side will be referred to as a second row.

As understood from FIGS. 3 and 4, in each of the first row and the second row, the mating contacts 200 are arranged at regular intervals in the pitch direction. The mating contacts 200 of the first row and the mating contacts 200 of the second row are arranged to be mirror images of each other.

As shown in FIGS. 3 and 4, each of the mating contacts 200 has a generally L-shape. In detail, each of the mating contacts 200 has a mating fixed portion 202, a mating held portion 204, a mating coupling portion 206, a mating extension portion 208 and a mating contact portion 210. The mating fixed portion 202 is fixed to a mating substrate (not shown). The mating held portion 204 is held by the mating housing 220. The mating coupling portion 206 couples the mating fixed portion 202 and the mating held portion 204 with each other. The mating extension portion 208 extends downward from the mating held portion 204. The mating extension portion 208 is resiliently deformable. The mating contact portion 210 is supported by the mating extension portion 208. In the present embodiment, the mating contact portion 210 is a part of a surface of the mating extension portion 208 and is a curved surface. The mating contact portion 210 is movable at least in the lateral direction due to resilient deformation of the mating extension portion 208.

Figure 5:
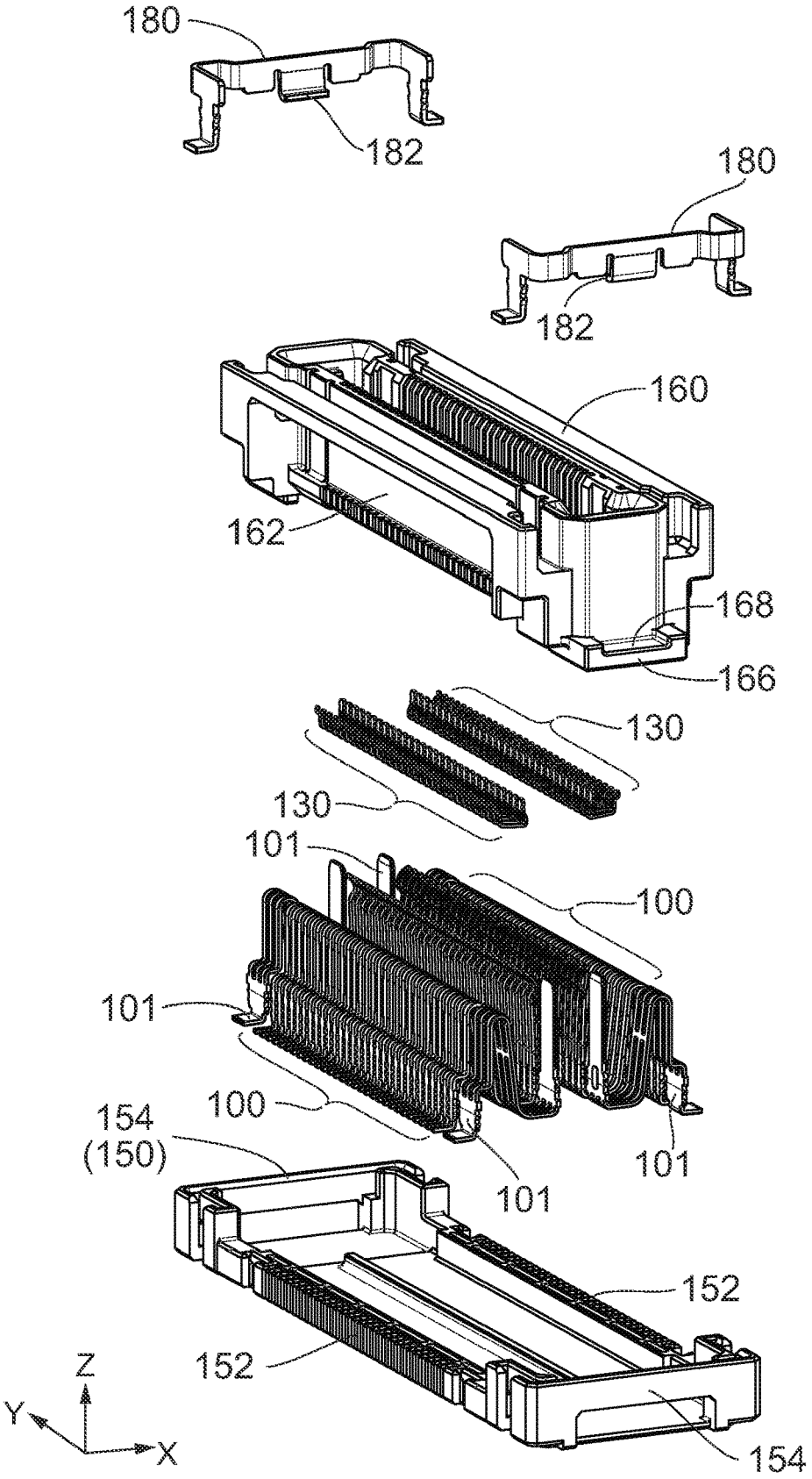
FIG. 5 is an exploded, perspective view showing the floating connector of FIG. 1.

Referring to FIG. 5, the floating connector 10 is provided with a plurality of contacts 100, a plurality of stub members 130, a fixed housing 150, a movable housing 160 and a pair of holddowns 180. However, the present invention is not limited thereto. The present invention does not necessarily require the fixed housing 150 and the holddowns 180. In that case, the floating connector 10 may use a locator (not shown) to arrange the contacts 100. The locator does not hold the contacts 100 and requires only low strength. Accordingly, in a case of using the locator, the floating connector 10 can be downsized in comparison with a case of using the fixed housing 150.

As shown in FIG. 5, the contacts 100 are arranged in two rows. However, the present invention is not limited thereto. The number and the arrangement of the contacts 100 should be decided according to the number and the arrangement of the mating contacts 200 (see FIG. 4). Accordingly, in the present invention, the contacts 100 may be arranged in one row.

Referring to FIG. 5, in the present embodiment, the rows of the contacts 100 are located apart from each other in the lateral direction. Similarly to the mating contacts 200, one of the two rows of the contacts 100 that is located on the positive X-side will be referred to as a first row while the other row located on the negative X-side will be referred to as a second row.

Referring to FIG. 5, in each of the first row of the contacts 100 and the second row of the contacts 100, the contacts 100 are arranged at regular intervals in the pitch direction. In the pitch direction, on both sides of each of the rows of the contacts 100, grounding members 101 are arranged. In addition, the contacts 100 of the first row and the contacts 100 of the second row are arranged to be mirror images of each other.

Figure 10:
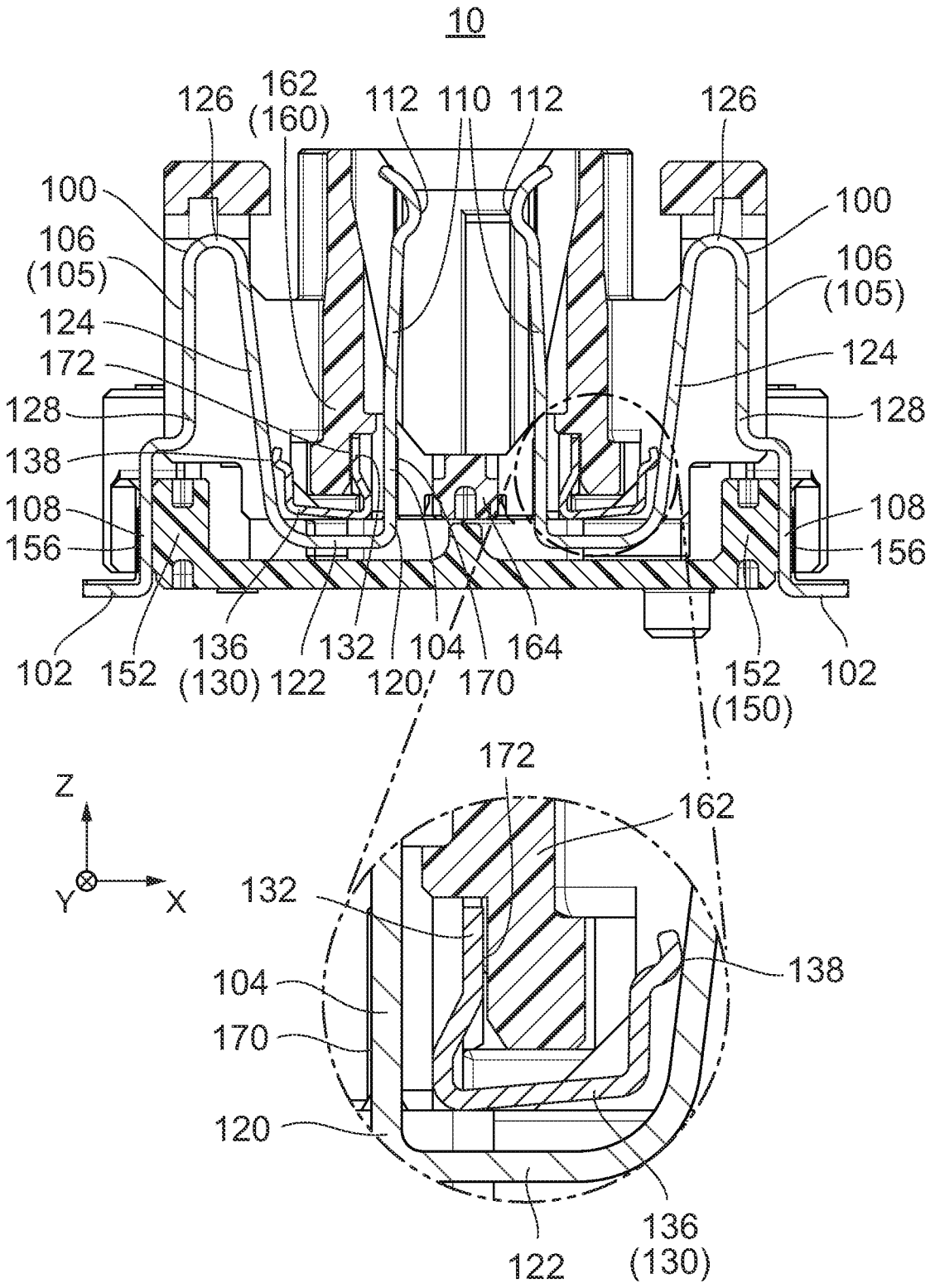
FIG. 10 is a cross-sectional view showing the floating connector of FIG. 1, taken along line A-A. A region surrounded by a chain double-dashed line is shown in an enlarged fashion.

As understood from FIGS. 5 and 10, the stub members 130 correspond to the contacts 100 in one-to-one correspondence. In other words, the stub members 130 are arranged in two rows along the pitch direction to form a first row and a second row. The first row of the stub members 130 and the second row of the stub members 130 are located apart from each other in the lateral direction. In each of the first row of the stub members 130 and the second row of the stub members 130, the stub members 130 are arranged at regular intervals in the pitch direction. The stub members 130 of the first row and the stub members 130 of the second row are arranged to be mirror images of each other.

Figure 6:
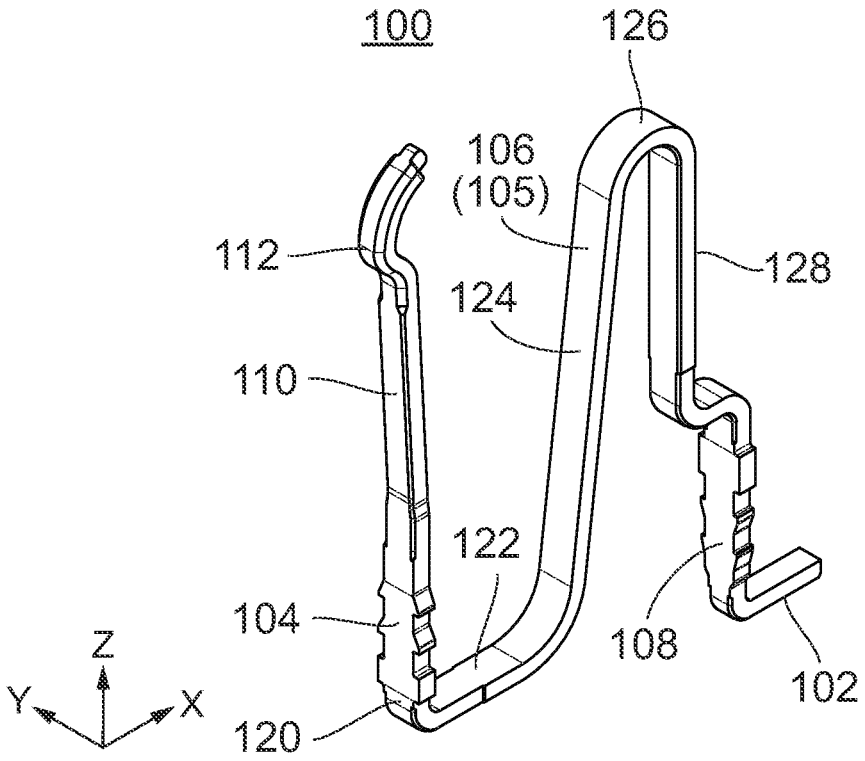
FIG. 6 is a perspective view showing a contact of a first row included in the floating connector of FIG. 5.

As shown in FIG. 6, each of the contacts 100 has a fixed portion 102, a middle-held portion (a first held portion) 104, a coupling portion 105, an extension portion 110 and a contact portion 112. In the present embodiment, the coupling portion 105 has a deformable portion 106 and a basal held portion (a third held portion) 108. However, the present invention is not limited thereto. In a case where the floating connector 10 does not have the fixed housing 150, the basal held portion 108 is unnecessary. In that case, the coupling portion 105 does not have the basal held portion 108. In other words, the coupling portion 105 is formed with only the deformable portion 106 in that case.

As shown in FIG. 6, the deformable portion 106 of the contact 100 has a first part 120, a first folded portion (a conversion portion) 122, a second part 124, a second folded portion 126 and a third part 128. The first part 120 extends downward from the middle-held portion 104. The first folded portion 122 is located at a lower end of the first part 120. The second part 124 extends upward from the first folded portion 122. The second folded portion 126 is located at an upper end of the second part 124. The third part 128 extends from the second folded portion 126 to the basal held portion 108. However, in the case where the floating connector 10 does not have the fixed housing 150, the third part 128 must extend from the second folded portion 126 to the fixed portion 102. Each of the contacts 100 may be made by stamping and bending a metal sheet, for example.

As understood from FIGS. 1 and 2, the fixed portion 102 of the contact 100 is fixed to the substrate 30 by means of soldering or the like. As understood from FIG. 3, the basal held portion 108 is held by the fixed housing 150. The middle-held portion 104 is held by the movable housing 160.

As shown in FIG. 6, the deformable portion 106 of the contact 100 couples the basal held portion 108 and the middle-held portion 104 with each other. The extension portion 110 extends upward from the middle-held portion 104. The contact portion 112 is supported by the extension portion 110. In the present embodiment, the contact portion 112 is a part of a surface of the extension portion 110 and is a curved surface. Each of the deformable portion 106 and the extension portion 110 is resiliently deformable. However, the present invention is not limited thereto. The extension portion 110 is not always necessary to be resiliently deformable. In a case where the extension portion 110 is not resiliently deformable, the extension portion 110 may have a blade or bar shape extending straight. In that case, the contact portion 112 is a part of the surface of the extension portion 110 and is a flat surface.

Figure 7:
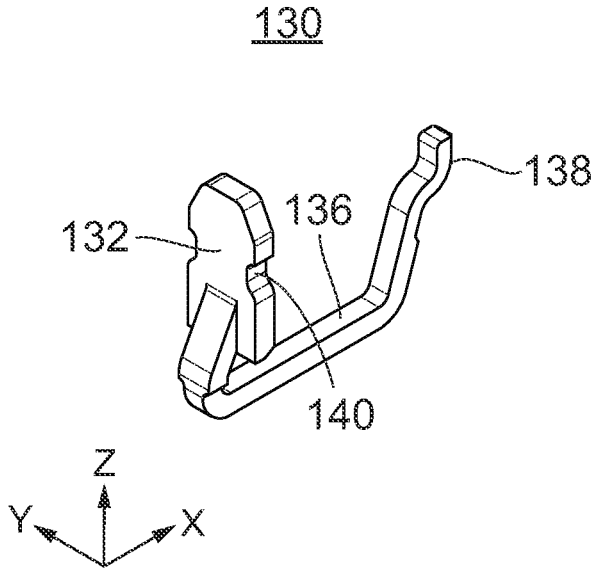
FIG. 7 is a perspective view showing a stub member of a first row included in the floating connector of FIG. 5.
Figure 8:
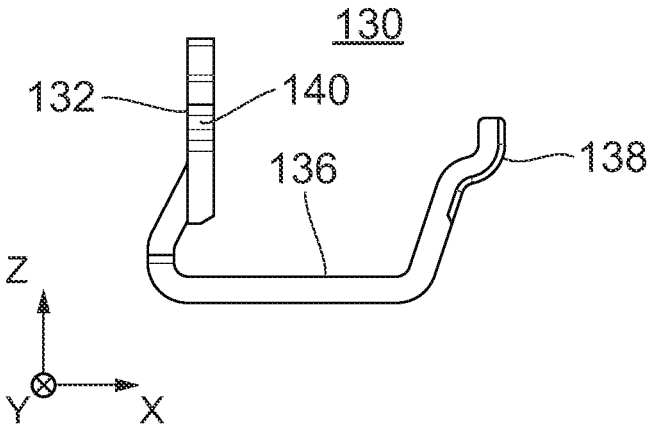
FIG. 8 is a front view showing the stub member of FIG. 7.
Figure 9:
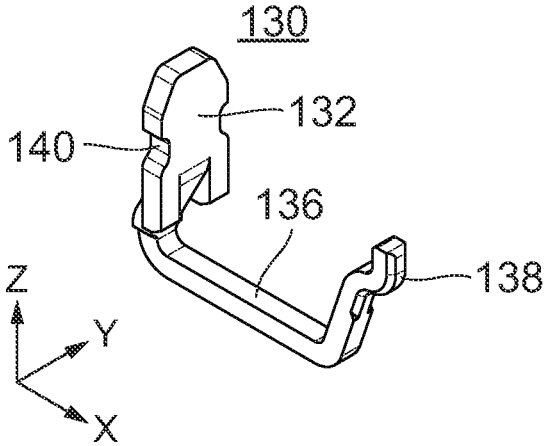
FIG. 9 is another perspective view showing the stub member of FIG. 7.

As shown in FIGS. 7 to 9, each of the stub members 130 has a held portion (a second held portion) 132, a supporting portion 136 and a stub contact point 138. The held portion 132 has a flat plate shape which is perpendicular to the lateral direction and long in the up-down direction. The held portion 132 has a narrow portion 140 in the middle portion thereof in the up-down direction. In the pitch direction, a size of the held portion 132 is larger than a size of the supporting portion 136. The supporting portion 136 extends diagonally downward from near the middle portion of the held portion 132, then extends in the lateral direction, and further extends diagonally upward. The stub contact point 138 is supported by the supporting portion 136 in the vicinity of a tip of the supporting portion 136. In the present embodiment, the stub contact point 138 is a part of a surface of the supporting portion 136 and is a curved surface. Moreover, in the present embodiment, the supporting portion 136 is resiliently deformable. The stub contact point 138 is movable at least in the lateral direction due to resilient deformation of the supporting portion 136. Each of the stub members 130 may be made by stamping and bending a metal sheet, for example.

As understood from FIG. 10, the movable housing 160 has a pair of long wall portions 162 and a middle bottom portion 164 located between the long wall portions 162. The movable housing 160 further has first holding portions 170 correspond to the contacts 100, respectively. In addition, the movable housing 160 has second holding portions 172 correspond to the stub members 130, respectively. In the present embodiment, each of the first holding portions 170 and the second holding portions 172 is a hole with a rectangular section. The hole is formed with a slit along a long direction. The slit of the first holding portion 170 is used for allowing the extension portion 110 of the contact 100 and the contact portion 112 of the contact 100 to pass. Moreover, the slit of the second holding portion 172 is used for allowing the supporting portion 136 of the stub member 130 to pass.

As understood from FIG. 10, the first holding portions 170 of the movable housing 160 are provided in both side portions of the middle bottom portion 164. Moreover, the second holding portions 172 of the movable housing 160 are provided in the long wall portions 162.

As shown in FIG. 10, the fixed housing 150 has a pair of long edge portions 152. Moreover, the fixed housing 150 has third holding portions 156 correspond to the contacts 100, respectively. The third holding portions 156 are provided in the long edge portions 152. In the present embodiment, each of the third holding portions 156 is a hole with a rectangular section. The hole is formed with a slit along in a long direction. The slit is used for allowing the fixed portion 102 of the contact 100 to pass.

As shown in FIG. 10, the first holding portion 170 of the movable housing 160 holds the middle-held portion 104 of the contact 100. Moreover, the second holding portion 172 of the movable housing 160 holds the held portion 132 of the stub member 130. Furthermore, the third holding portion 156 of the fixed housing 150 holds the basal held portion 108 of the contact 100. Thus, the contacts 100 are held by the movable housing 160 and the fixed housing 150, and the stub members 130 are held by the movable housing 160.

As understood from FIGS. 5 to 10, the held portion 132 of the stub member 130 is press-fitted in the second holding portion 172 of the movable housing 160 from beneath to be held. Moreover, the basal held portion 108 of the contact 100 is press-fitted in the third holding portion 156 of the fixed housing 150 from above to be held. Furthermore, the middle-held portion 104 of the contact 100 is press-fitted in the first holding portion 170 of the movable housing 160 from beneath to be held. The fixed housing 150 and the movable housing 160 are coupled to each other by the contacts 100. As described above, the deformable portion 106 of the contact 100 resiliently deformable. Accordingly, the movable housing 160 is movable with respect to the fixed housing 150 within a predetermined range in a plane perpendicular to the up-down direction.

As shown in FIG. 10, each of the stub members 130 and the contact 100 corresponding thereto are in contact with each other. In detail, the stub contact point 138 of the stub member 130 is in contact with the deformable portion 106 of the contact 100 corresponding thereto. In more detail, the stub contact point 138 is located, in the lateral direction, between the first part 120 and the second part 124 of the contact 100 corresponding thereto and pressed against the second part 124. In the present embodiment, in order to realize this contact, the deformable portion 106 of each of the contacts 100 and the stub contact point 138 of the stub member 130 corresponding thereto are located at positions overlapping with each other in the pitch direction in an unmated state.

As understood from FIGS. 1 and 5, the holddowns 180 are attached to short edge portions 154 of the fixed housing 150 and fixed to the substrate 30. The fixed housing 150 is fixed to the substrate 30 with the holddowns 180. Moreover, the holddowns 180 prevent ledge portions 166 of the movable housing 160 from being moved upward. In detail, each of the holddowns 180 has a tub 182, and the tub 182 is located in a recess 168 in part, wherein the recess 168 is formed in the ledge portion 166 of the movable housing 160. The tubs 182 of the holddowns 180 allow movement of the movable housing 160 within the predetermined range in the plane perpendicular to the up-down direction.

Figure 11:
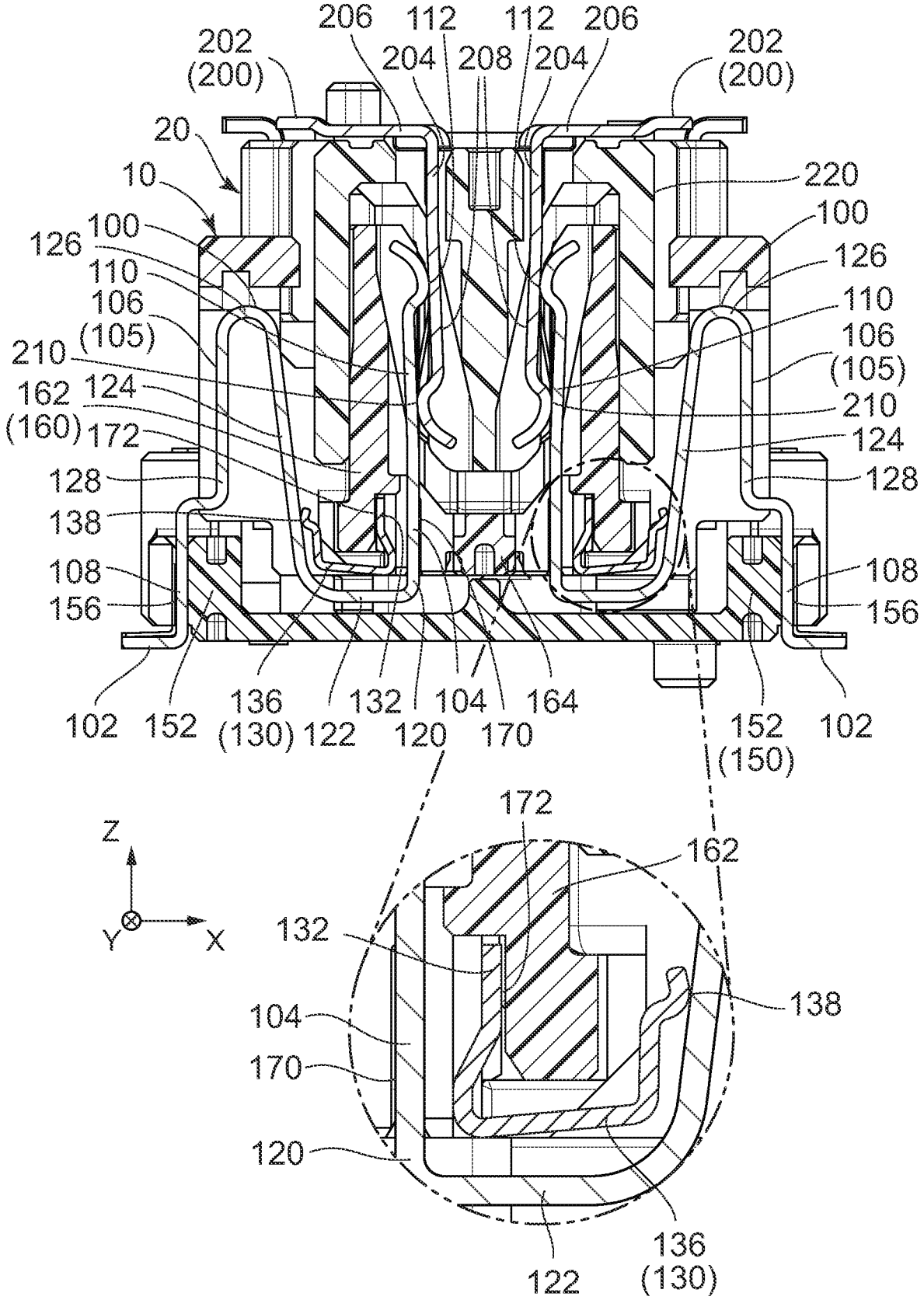
FIG. 11 is a cross-sectional view showing the floating connector and the mating connector of FIG. 2, take along line B-B. A region surrounded by a chain double-dashed line is shown in an enlarged fashion.

As shown in FIG. 11, when the floating connector 10 is mated with the mating connector 20, the contact portions 112 of the contacts 100 come into contact with the mating contacts 200, respectively. Moreover, the mating contact portions 210 of the mating contacts 200 come into contact with the contacts 100, respectively. The contact portion 112 of each of the contacts 100 is supported by the extension portion 110, which is resiliently deformable, and is movable at least in the lateral direction. Similarly, the mating contact portion 210 of each of the mating contacts 200 is supported by the extension portion 110 and is movable at least in the lateral direction. With this structure, mating and removing of the floating connector 10 and the mating connector 20 are allowed. When the floating connector 10 and the mating connector 20 are mated with each other, the contact portion 112 comes into contact with the mating contact portion 210. Moreover, when the floating connector 10 and the mating connector 20 are mated with each other, a reaction force of the extension portion 110 of the contact 100 and a reaction force of the extension portion 110 of the mating connector 20 ensure electrical connection between the contact 100 and the mating contact 200.

Referring to FIG. 11, the deformable portion 106 of the contact 100 is deformable as described above. Accordingly, even when the movable housing 160 is moved with respect to the fixed housing 150 within the predetermined range in the plane perpendicular to the up-down direction, the contact 100 and the mating contact 200 keep in contact with each other. Moreover, the supporting portion 136 of the stub member 130 is resiliently deformable. Accordingly, the stub contact point 138 is always pressed against the deformable portion 106 by a reaction force thereof even when the deformable portion 106 of the contact 100 corresponding thereto is resiliently deformed. However, the present invention is not limited thereto. The supporting portion 136 of the stub member 130 may not be always resiliently deformable. The stub member 130 should be structured or arranged so that the stub contact point 138 thereof is always pressed against the deformable portion 106 of the contact 100 corresponding thereto even when the movable housing 160 is moved with respect to the fixed housing 150. For example, the stub member 130 may be formed not to be resiliently deformable, and the stub contact point 138 may be pressed against a resiliently deformable part of the contact 100. In that case, the stub contact point 138 is always pressed against the contact 100 due to a reaction force caused by resilient deformation of the contact 100.

As described above, in the floating connector 10 according to the present embodiment, the stub member 130 is always electrically connected to the contact 100 corresponding thereto through the stub contact point 138. Accordingly, an impedance of the contact 100 can be reduced without providing a wide adjustment portion to the contact 100.

Second Embodiment

Figure 12:
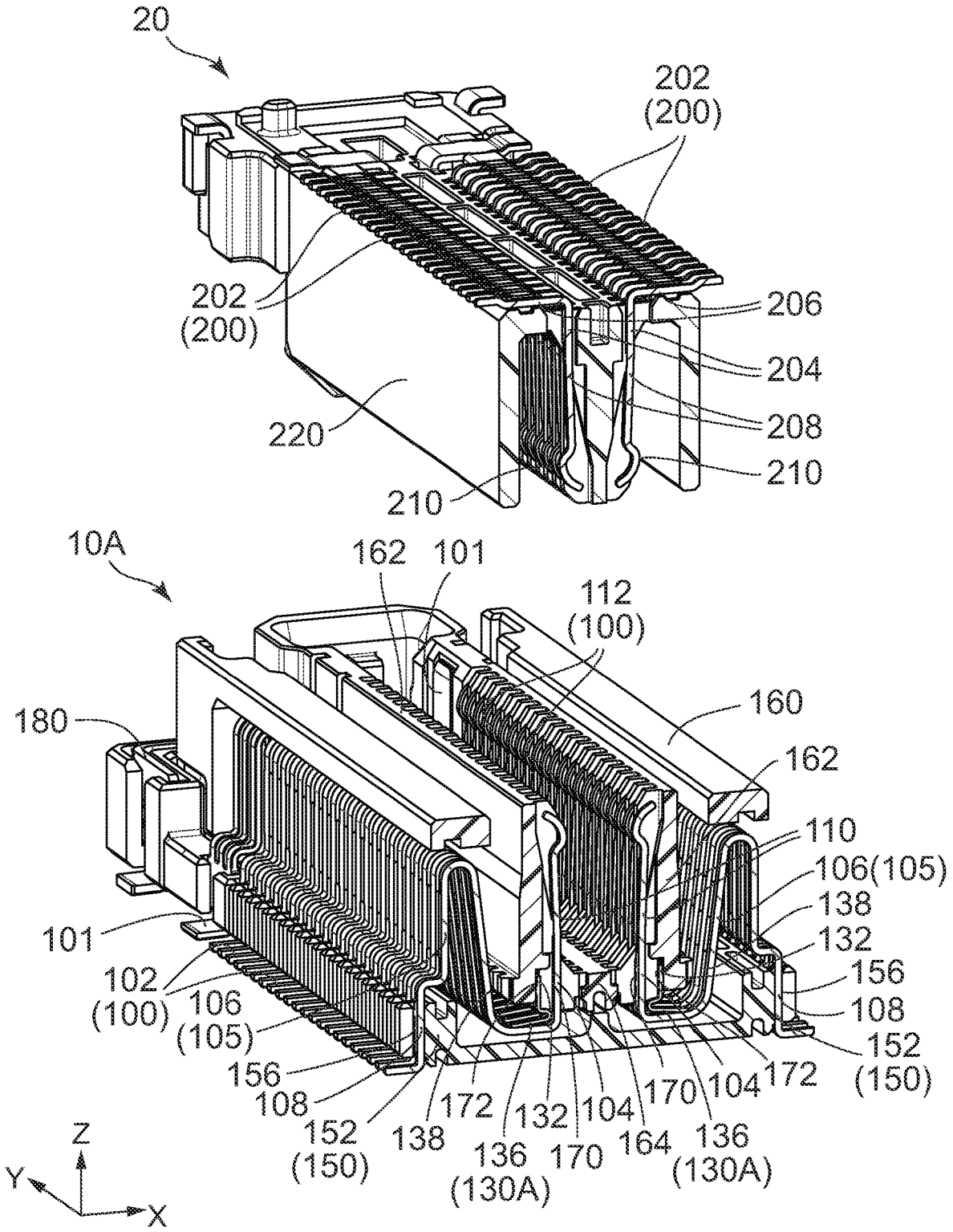
FIG. 12 is a perspective, cross-sectional view showing a floating connector according to a second embodiment of the present invention and a mating connector. The floating connector and the mating connector are not mated with each other. A position of the cross section corresponds to that of the line A-A of FIG. 1.
Figure 13:
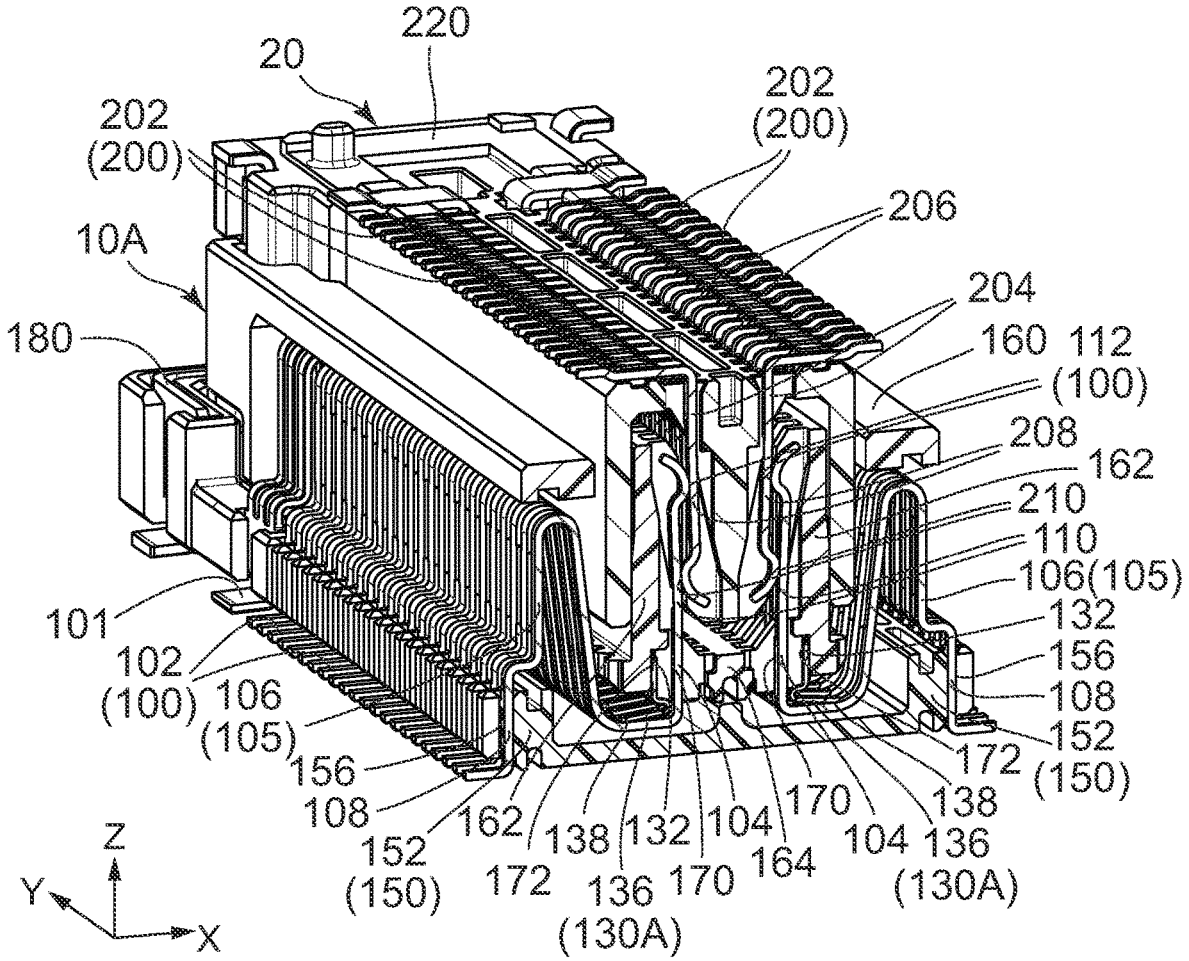
FIG. 13 is a perspective, cross-sectional view showing the floating connector and the mating connector of FIG. 12. The floating connector and the mating connector are mated with each other. A position of the cross section corresponds to that of the line B-B of FIG. 2.
Figure 14:
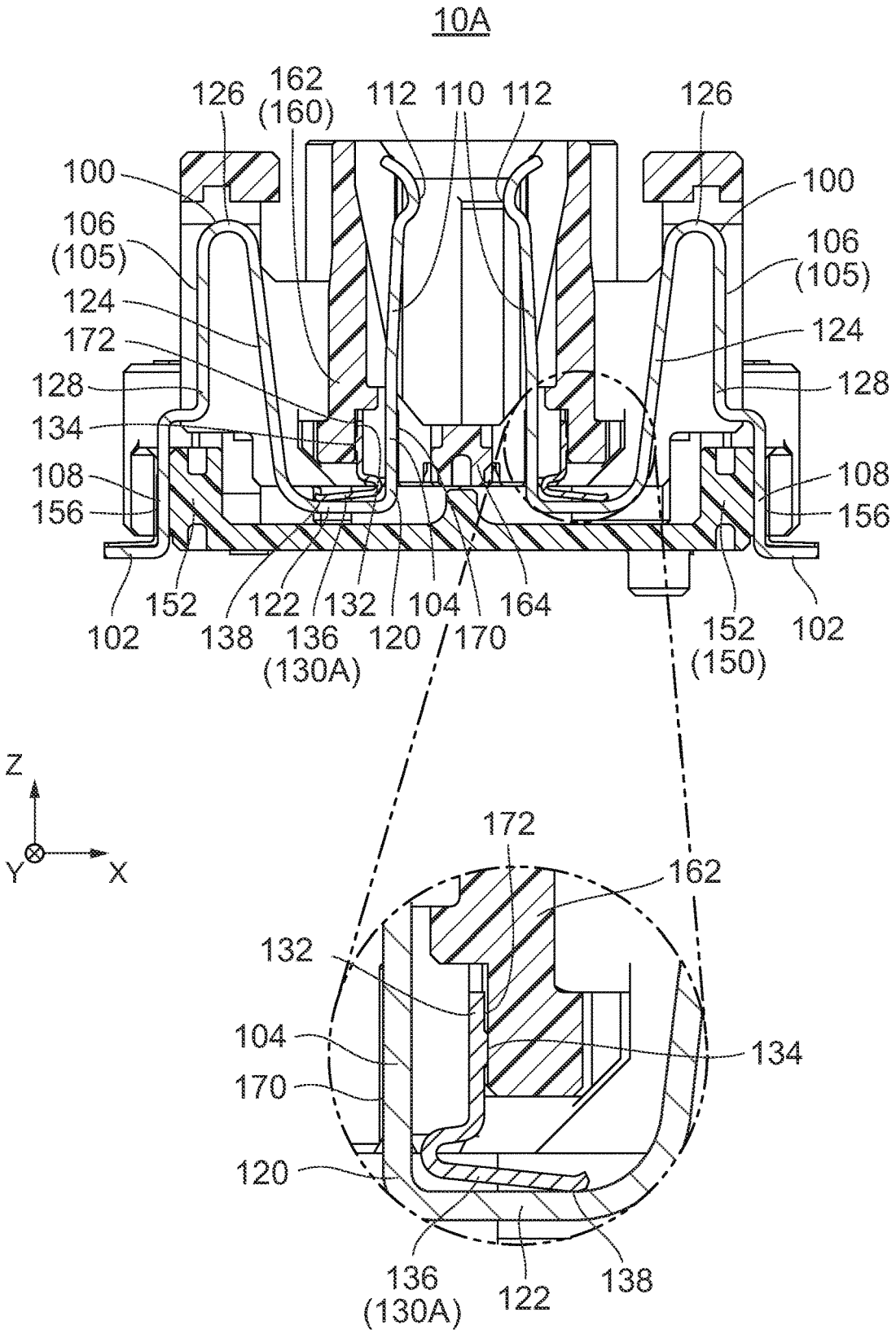
FIG. 14 is a cross-sectional view showing the floating connector of FIG. 12. A region surrounded by a chain double-dashed line is shown in an enlarged fashion.

Referring to FIGS. 12 to 14, a floating connector 10A according to a second embodiment of the present invention has stub members 130A each of which has a shape different from that of the stub member 130 of the floating connector 10 according to the first embodiment. In other words, the floating connector 10A of the present embodiment is formed similarly to the floating connector 10 of the first embodiment except for the stub members 130A.

Figure 15:
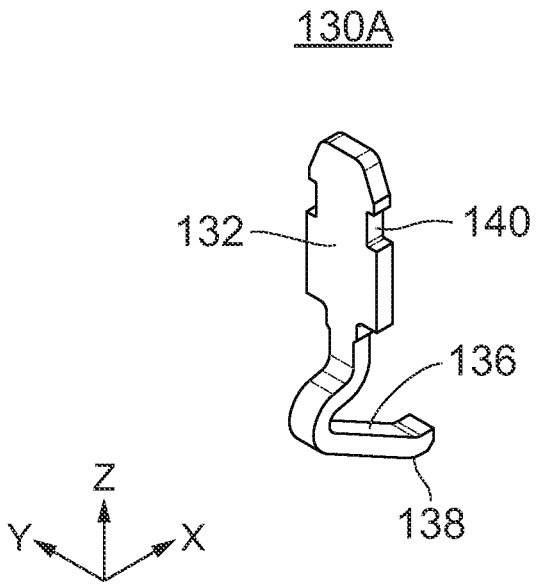
FIG. 15 is a perspective view showing a stub member of a first row included in the floating connector of FIG. 14.
Figure 16:
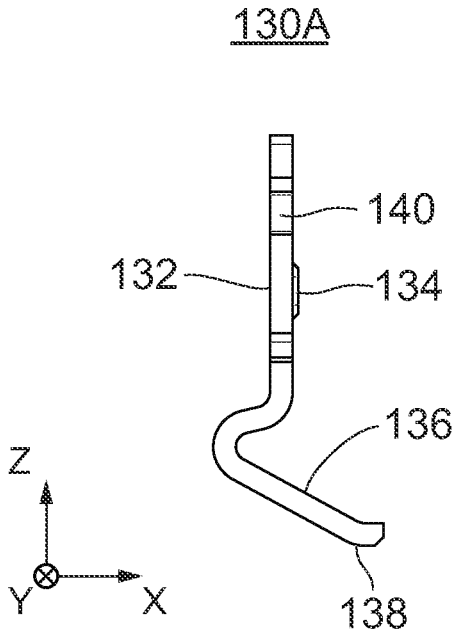
FIG. 16 is a front view showing the stub member of FIG. 15.
Figure 17:
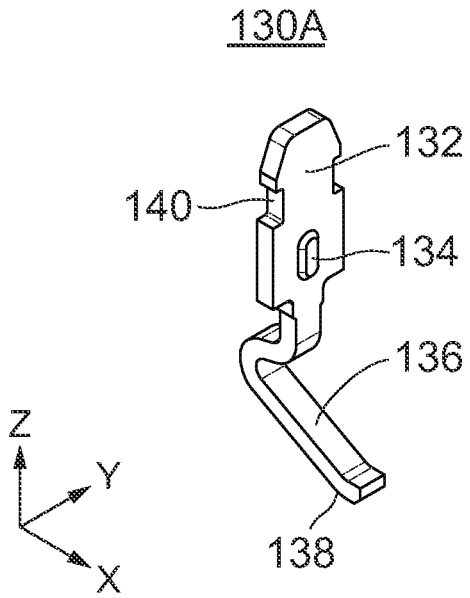
FIG. 17 is another perspective view showing the stub member of FIG. 16.

As shown in FIGS. 15 to 17, each of the stub members 130A in the floating connector 10A of the present embodiment has a held portion (a second held portion) 132, a supporting portion 136 and a stub contact point 138. The held portion 132 has a plate shape which is perpendicular to the lateral direction and long in the up-down direction. The held portion 132 further has a narrow portion 140 near the middle portion thereof in the up-down direction. Furthermore, on a surface of the held portion 132, a protruding portion 134 is provided. In the pitch direction, a size of the held portion 132 is larger than a size of the supporting portion 136. The supporting portion 136 extends downward from a lower end of the held portion 132, then extends diagonally downward, and further extends diagonally downward after bent back. The stub contact point 138 is supported by the supporting portion 136 in the vicinity of a tip of the supporting portion 136. In the present embodiment, the stub contact point 138 is a part of a surface of the supporting portion 136 and is a curved surface. Moreover, in the present embodiment, the supporting portion 136 is resiliently deformable. The stub contact point 138 is moveable at least in the up-down direction due to resilient deformation of the supporting portion 136. Each of the stub members 130A may be made by stamping and bending a metal sheet, for example.

As understood from FIGS. 12 to 14, the held portion 132 of the stub member 130A is held by the second holding portion 172 of the movable housing 160. The stub contact point 138 is located upward of the first folded portion (the conversion portion) 122 of the deformable portion 106 of the contact 100 corresponding thereto in the up-down direction and pressed against the first folded portion 122 by a reaction force of the supporting portion 136. Here, the first folded portion 122 is located relatively near the middle-held portion 104. Accordingly, even when the movable housing 160 is moved with respect to the fixed housing 150 and the contacts 100 are resiliently deformed, a deformation amount and a movement amount of the first folded portion 122 are small. In detail, the stub contact point 138 is pressed against the first folded portion 122 in a downward direction (the negative Z-direction) of the up-down direction. On the other hand, a direction of relative movement between the fixed housing 150 and the movable housing 160 is a direction perpendicular to the up-down direction (an X-Y direction), and the relative movement in the up-down direction (the Z-direction) is small. Accordingly, movement of the first folded portion 122 in the up-down direction is small. Therefore, relative movement between the stub contact point 138 of the stub member 130A and the contact 100 is small, so that contact stability between the stub contact point 138 and the contact 100 is higher than that of the first embodiment.

In the floating connector 10A according to the present embodiment, the stub member 130A is always electrically connected to the contact 100 corresponding thereto through the stub contact point 138. Accordingly, an impedance of the contact 100 can be reduced without providing a wide adjustment portion to the contact 100.

Third Embodiment

Figure 18:
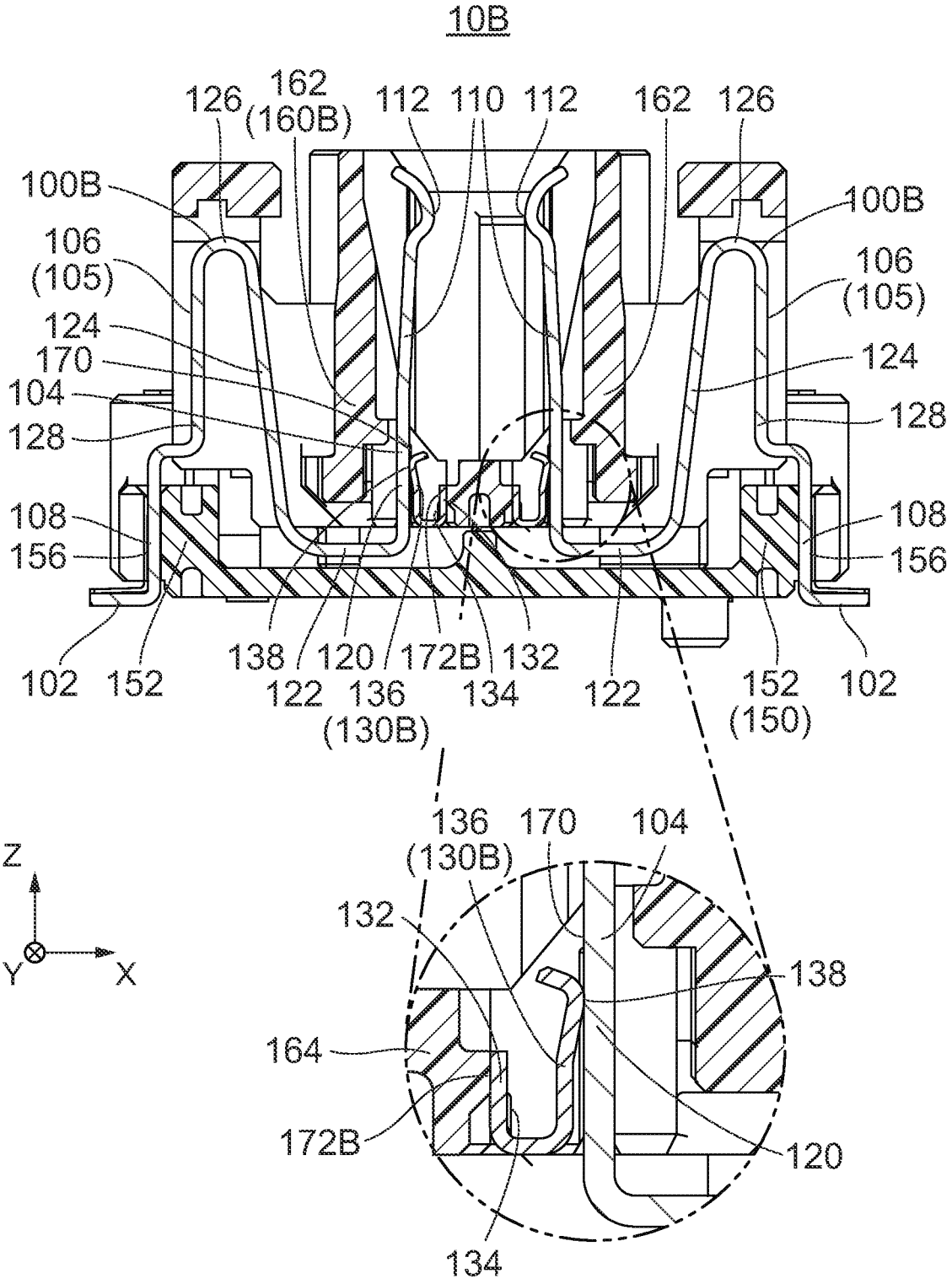
FIG. 18 is a cross-sectional view showing a floating connector according to a third embodiment of the present invention. A position of the cross section corresponds to that of the line A-A of FIG. 1.

Referring to FIG. 18, a floating connector 10B according to a third embodiment of the present invention has stub members 130B each of which is different from the stub member 130A of the floating connector 10A of the second embodiment in position and shape. In connection with this, the floating connector 10B of the present embodiment is provided with contacts 100B and a movable housing 160B which are different from the contacts 100 and the movable housing 160 of the floating connector 10A of the second embodiment, respectively. In other words, the floating connector 10B of the present embodiment is formed similarly to the floating connector 10A of the second embodiment except for the movable housing 160, the stub members 130B and the contacts 100B.

Figure 19:
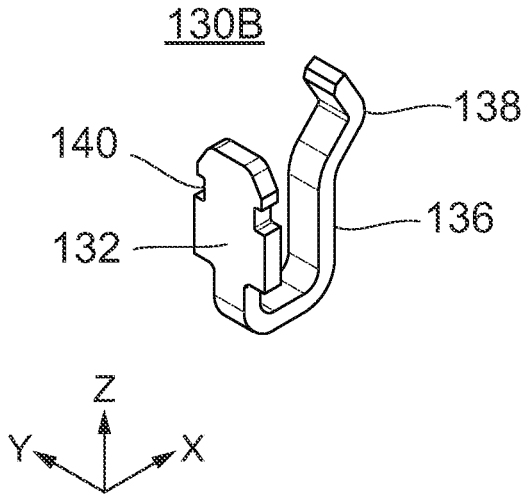
FIG. 19 is a perspective view showing a stub member of a first row included in the floating connector of FIG. 18.
Figure 20:
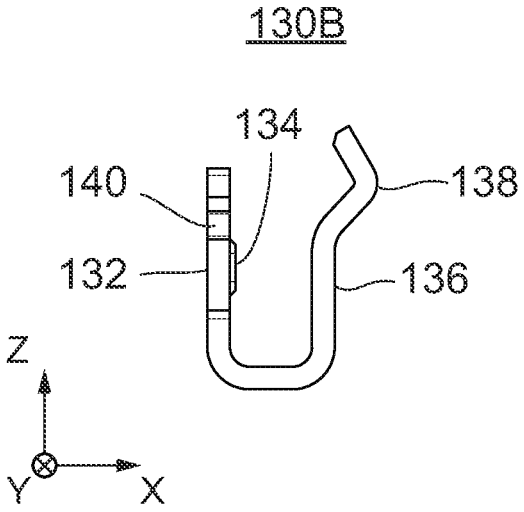
FIG. 20 is a front view showing the stub member of FIG. 19.
Figure 21:
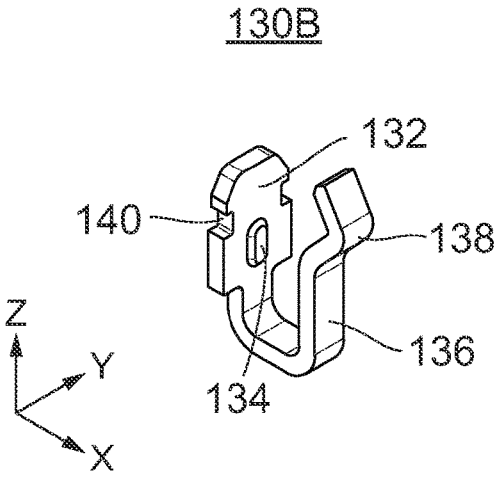
FIG. 21 is another perspective view showing the stub member of FIG. 19.

As shown in FIGS. 19 to 21, each of the stub members 130B in the floating connector 10B of the present embodiment has a held portion (a second held portion) 132, a supporting portion 136 and a stub contact point 138. The held portion 132 has a shape similar to that of the held portion 132 of the stub members 130A. The supporting portion 136 extends downward from a lower end of the held portion 132, then extends in the lateral direction, and further extends upward. The stub contact point 138 is supported by the supporting portion 136 in the vicinity of a tip of the supporting portion 136. In the present embodiment, the stub contact point 138 is a part of a surface of the supporting portion 136. Moreover, in the present embodiment, the supporting portion 136 is resiliently deformable. The stub contact point 138 is moveable at least in the lateral direction due to resilient deformation of the supporting portion 136. Each of the stub members 130B is made by stamping and bending a metal sheet, for example.

As shown in FIG. 18, a middle bottom portion 164 of the movable housing 160B is provided with second holding portions 172B. Each of the second holding portions 172B is a hole with a rectangular section and is formed with a slit along a long direction. The slit is used for allowing the protruding portion 134 of the stub member 130 to pass. The held portion 132 of the stub member 130B is press-fitted in the second holding portion 172B from beneath the movable housing 160B. In this way, the stub member 130B is held by the movable housing 160B. And, the stub contact point 138 is pressed against a first part 120 of the contact 100B in the lateral direction.

As understood from FIG. 18, the first part 120 of the contact 100B is longer than the first part 120 of the contact 100 (see FIG. 6) in the up-down direction so that the stub contact point 138 comes into contact with the first part 120 of the contact 100B. In other words, the middle-held portion 104 of the contact 100B is located upward of the middle-held portion 104 of the contact 100 to be near a tip of the contact 100B. The first holding portions 170 of the movable housing 160B are located upward of the first holding portions 170 of the movable housing 160. These are because of preventing the stub contact point 138 from coming into contact with the middle-held portion 104. This is because the middle-held portion 104 is wider than the first part 120 so that the impedance drops too much locally when the stub contact point 138 comes into contact with the middle-held portion 104. However, the stub contact point 138 may be pressed against the middle-held portion (the first held portion) 104 according to desired characteristics.

In the floating connector 10B according to the present embodiment, the stub member 130B is always electrically connected to the contact 100 corresponding thereto through the stub contact point 138. Accordingly, an impedance of the contact 100 can be reduced without providing a wide adjustment portion to the contact 100.

Fourth Embodiment

Figure 22:
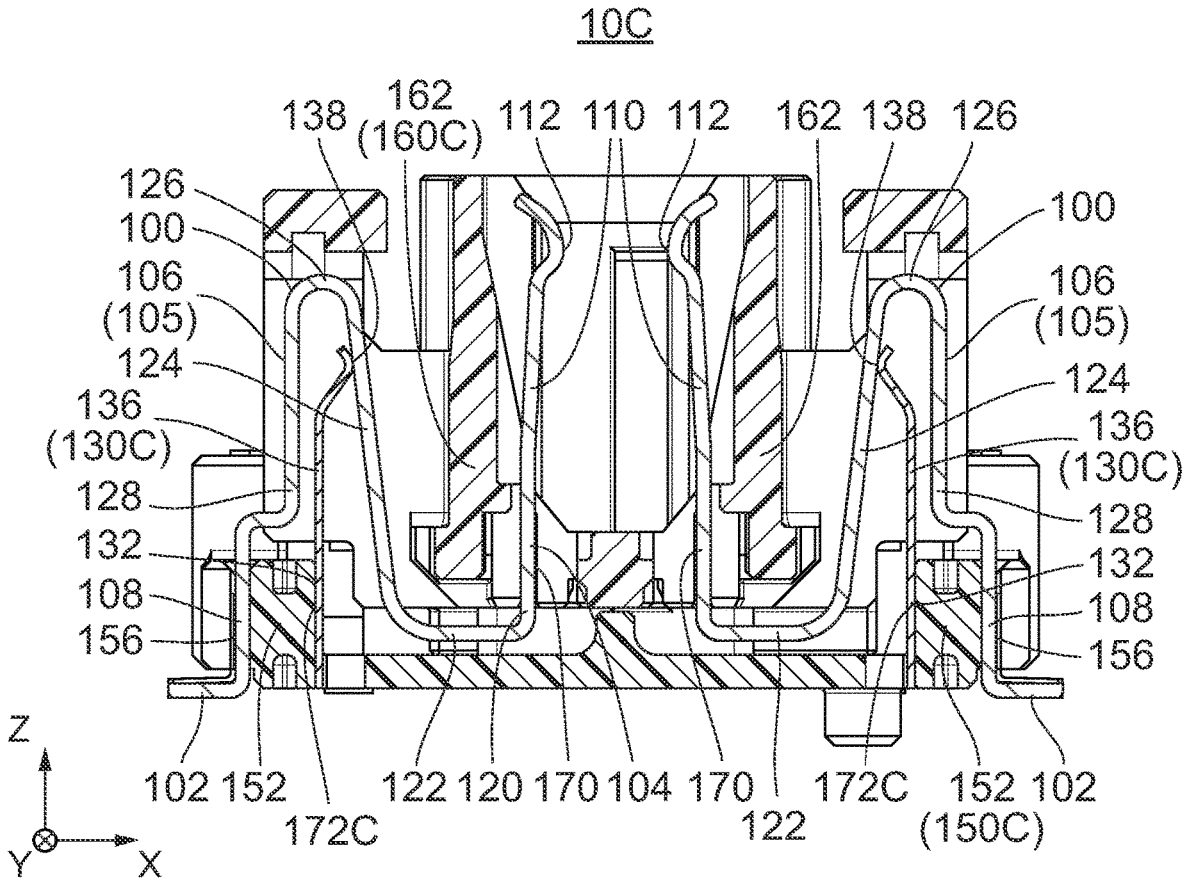
FIG. 22 is a cross-sectional view showing a floating connector according to a fourth embodiment of the present invention. A position of the cross section corresponds to that of the line A-A of FIG. 1.

Referring to FIG. 22, a floating connector 10C according to the present embodiment is different from the floating connector 10 according to the first embodiment in shape and position of a stub member 130C. In detail, a movable housing 160C of the floating connector 10C according to the present embodiment is not provided with the second holding portion 172, but the fixed housing 150 is provided with second holding portions 172C. In the present embodiment, each of the second holding portions 172C is a hole with a rectangular section and is formed with a slit along a long direction. The slit is used for allowing the supporting portion 136 and the stub contact point 138 to pass.

As shown in FIG. 22, the stub member 130C has a held portion 132, a supporting portion 136 and a stub contact point 138. The held portion 132 is held by the second holding portion 172C of the fixed housing 150. The supporting portion 136 extends upward from an upper end of the held portion 132 and then extends diagonally upward. The stub contact point 138 is supported by the supporting portion 136. In the present embodiment, the stub contact point 138 is a part of a surface of the supporting portion 136 and is a curved surface. Moreover, the supporting portion 136 is resiliently deformable. The stub contact point 138 is movable at least in the lateral direction due to resilient deformation of the supporting portion 136.

As shown in FIG. 22, the stub member 130C is located between the second part 124 of the deformable portion 106 and the third part 128 of the deformable portion 106 in the lateral direction. The stub contact point 138 is pressed against the second part 124 of the contact 100 corresponding thereto.

In the floating connector 10C according to the present embodiment, the stub member 130C is always electrically connected to the contact 100 corresponding thereto through the stub contact point 138. Accordingly, an impedance of the contact 100 can be reduced without providing a wide adjustment portion to the contact 100.

Fifth Embodiment

Figure 23:
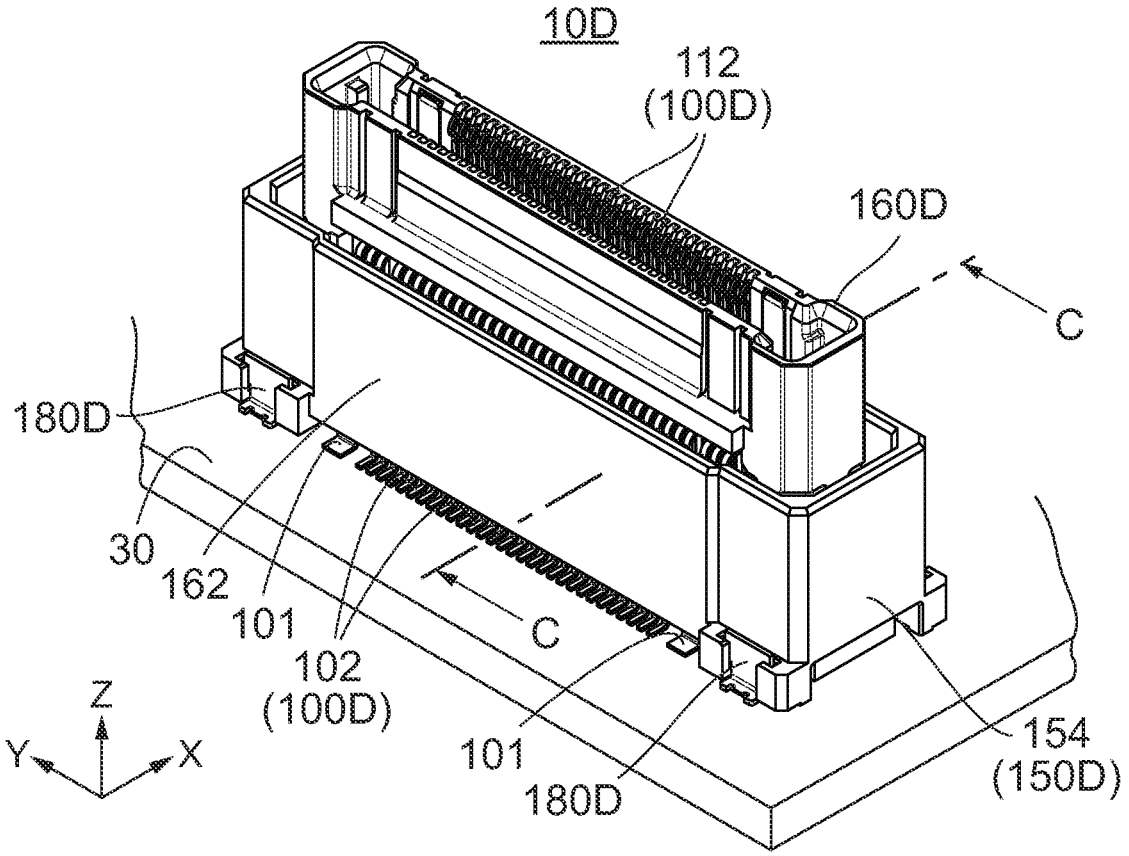
FIG. 23 is a perspective view showing a floating connector according to a fifth embodiment of the present invention.

Referring to FIG. 23, a floating connector 10D according to a fifth embodiment of the present invention is a tall-type floating connector.

Figure 24:
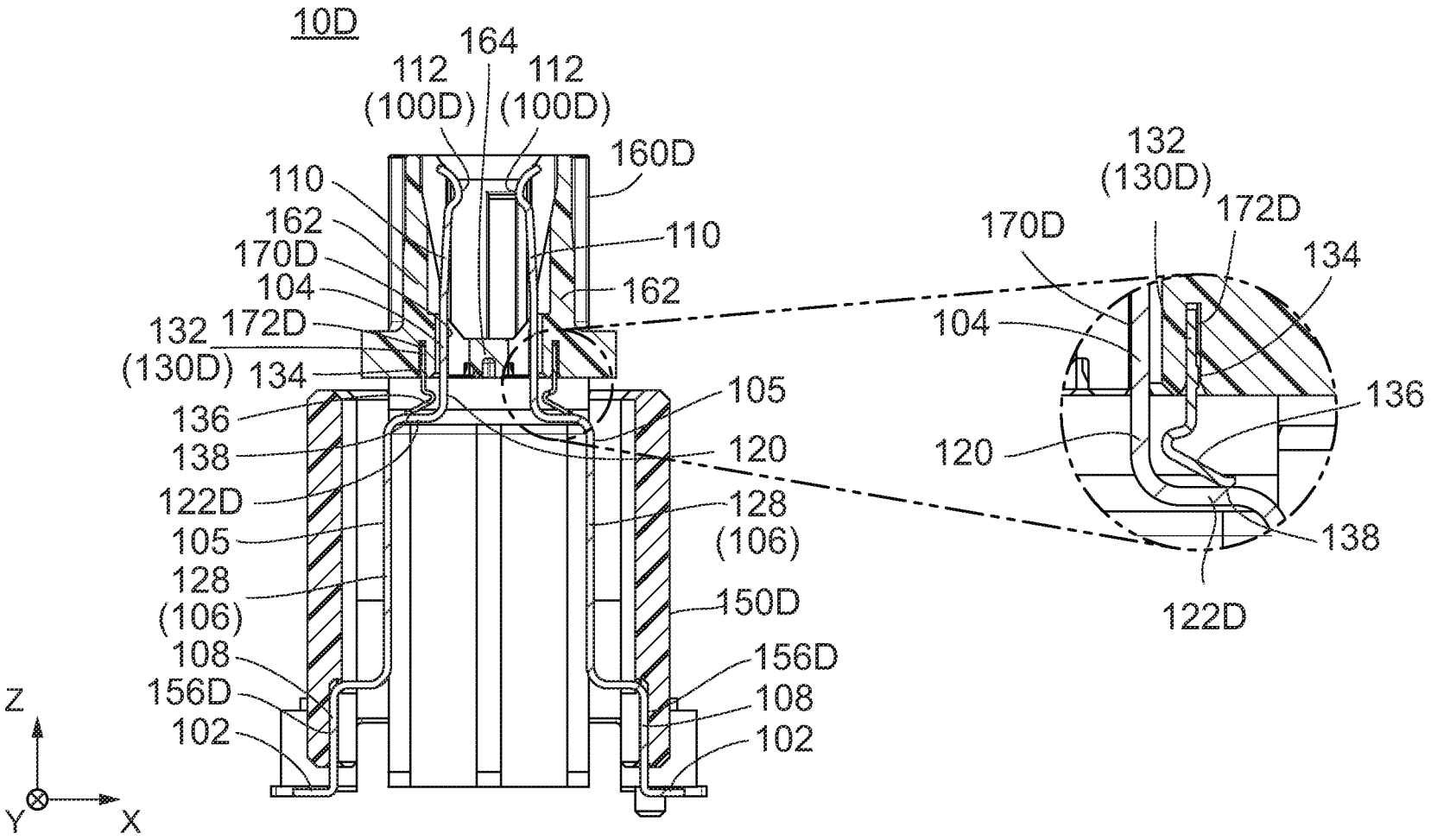
FIG. 24 is a cross-sectional view showing the floating connector of FIG. 23, taken along line C-C. A region surrounded by a chain double-dashed line is shown in an enlarged fashion.

As shown in FIGS. 23 and 24, the floating connector 10D is provided with a plurality of contacts 100D, a plurality of stub members 130D, a fixed housing 150D, a movable housing 160D and a pair of holddowns 180D.

As understood from FIGS. 23 and 24, the contacts 100D are arranged in two rows along the pitch direction to form a first row and a second row. The first row of the contacts 100D and the second row of the contacts 100D are apart from each other in the lateral direction. In each of the first row of the contacts 100D and the second row of the contacts 100D, the contacts 100 are arranged at regular intervals in the pitch direction. The stub members 130D correspond to the contacts 100D in one-to-one correspondence. The stub members 130D are also arranged in two rows to form a first row and a second row. The first row of the stub members 130D and the second row of the stub members 130D are apart from each other in the lateral direction. In each of the first row of the stub members 130D and the second row of the stub members 130D, the stub members 130D are arranged at regular intervals in the pitch direction.

As shown in FIG. 24, each of the contacts 100D has a fixed portion 102, a middle-held portion (a first held portion) 104, a coupling portion 105, a basal held portion (a third held portion) 108, an extension portion 110 and a contact portion 112. The coupling portion 105 has a deformable portion 106 and a basal held portion 108. Moreover, the deformable portion 106 has a first part 120, a conversion portion 122D and a third part 128. The first part 120 extends downward from the middle-held portion 104. The conversion portion 122D extends from a lower end of the first part 120 in the lateral direction. The third part 128 extends downward from a tip of the conversion portion 122D to the fixed portion 102. Each of the contacts 100D may be made by stamping and bending a metal sheet, for example.

As understood from FIG. 24, the stub member 130D is formed similar to the stub member 130A shown in FIGS. 15 to 17. In other words, the stub member 130D has a held portion 132, a supporting portion 136 and a stub contact point 138.

As shown in FIG. 24, the movable housing 160D has first holding portions 170D and second holding portions 172D. Moreover, the fixed housing 150D has third holding portions 156D. In the present embodiment, the first holding portions 170D, the second holding portions 172D and the third holding portions 156D are holes each of which has a rectangular section. Each of holes of the first holding portions 170D and the third holding portions 156D is provided with a slit along a long direction. The slit of the first holding portion 170 is used for allowing the extension portion 110 and the contact portion 112 to pass. The slit of the third holding portion 156 is used for allowing the third part 128 to pass.

As shown in FIG. 24, the first holding portions 170D of the movable housing 160D hold the middle-held portions 104 of the contacts 100D. Moreover, the second holding portions 172D of the movable housing 160D hold the held portions 132 of the stub members 130D. Furthermore, the third holding portions 156D of the fixed housing 150D hold the basal held portions 108 of the contacts 100D. Thus, the contacts 100D are held by the movable housing 160 and the fixed housing 150D, and the stub members 130D are held by the movable housing 160D.

As understood from FIG. 24, the held portion 132 of the stub member 130D is press-fitted in the second holding portion 172 of the movable housing 160D from beneath to be held. Moreover, the basal held portion 108 of the contact 100D is press-fitted in the third holding portion 156D of the fixed housing 150D from beneath to be held. Furthermore, the middle-held portion 104 of the contact 100D is press-fitted in the first holding portion 170D of the movable housing 160D from beneath to be held. The fixed housing 150D and the movable housing 160D are coupled to each other by the contacts 100D. The deformable portion 106 of the contact 100D is resiliently deformable. Accordingly, the movable housing 160D is movable with respect to the fixed housing 150D within a predetermined range in a plane perpendicular to the up-down direction.

As shown in FIG. 24, each of the stub members 130D and the contact 100D corresponding thereto are in contact with each other. In detail, the stub contact point 138 of the stub member 130D is in contact with the deformable portion 106 of the contact 100D corresponding thereto. In more detail, the stub contact point 138 is located upward of the conversion portion 122D in the up-down direction and pressed against the conversion portion 122D.

As understood from FIG. 23, the holddowns 180D are used to fix the fixed housing 150D to the substrate 30. Moreover, the holddowns 180D prevent the movable housing 160D from being moved upward. On the other hand, the holddowns 180D allow movement of the movable housing 160D within the predetermined range in the plane perpendicular to the up-down direction.

Referring to FIG. 24, the stub contact point 138 is always pressed against the deformable portion 106 of the contact 100D corresponding thereto even when the movable housing 160D is moved within the predetermined range in the plane perpendicular to the up-down direction. In the present embodiment, the supporting portion 136 of the stub member 130D is resiliently deformable and always presses the stub contact point 138 against the deformable portion 106 due to a reaction force thereof.

In the floating connector 10D according to the present embodiment, the stub member 130D is always electrically connected to the contact 100D corresponding thereto through the stub contact point 138. Accordingly, an impedance of the contact 100D can be reduced without providing a wide adjustment portion to the contact 100D.

Sixth Embodiment

Figure 25:
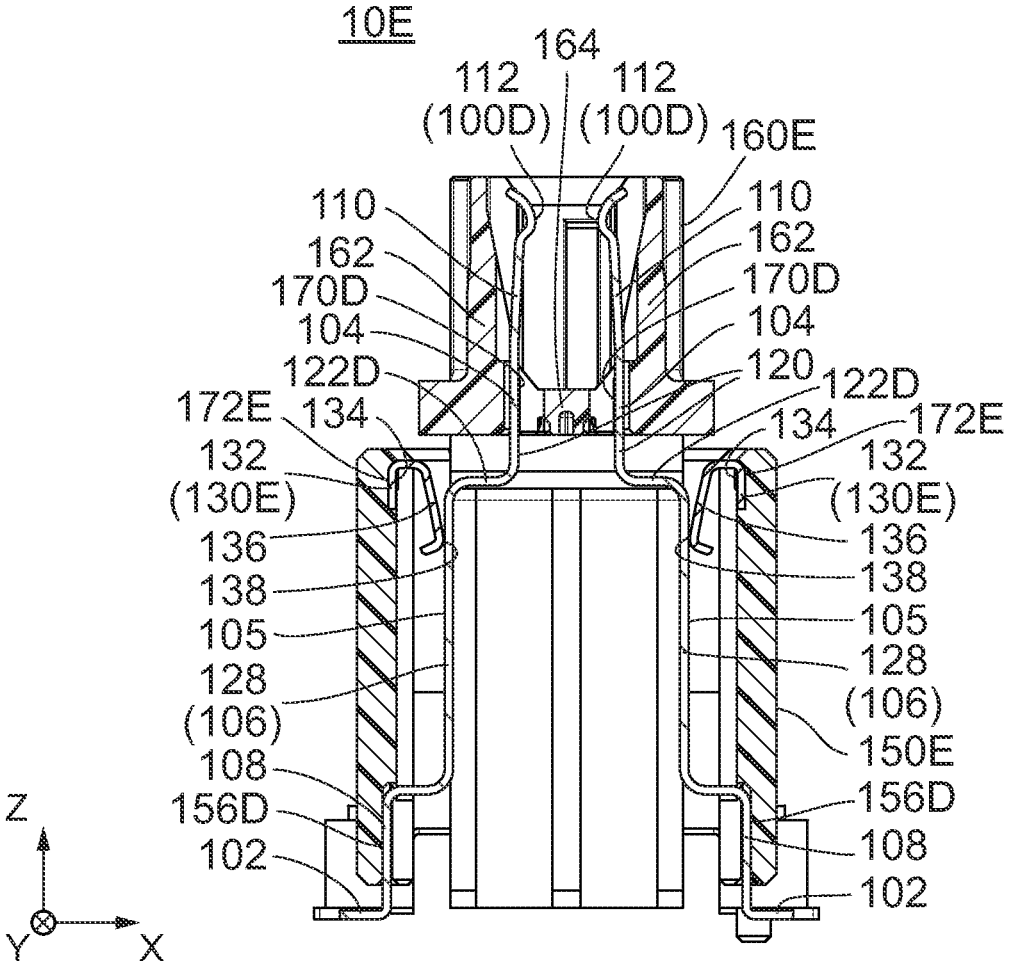
FIG. 25 is a cross-sectional view showing a floating connector according to a sixth embodiment of the present invention. A position of the cross section corresponds to that of the line C-C of FIG. 23.

Referring to FIG. 25, a floating connector 10E according to a sixth embodiment of the present invention is provided with stub members 130E each of which is different from the stub member 130D of the floating connector 10D of the fifth embodiment in shape and position. In connection with this, the floating connector 10E of the present embodiment is provided with a fixed housing 150E and a movable housing 160E which are different from the fixed housing 150D the movable housing 160D of the floating connector 10D of the fifth embodiment, respectively. In other words, the floating connector 10E of the present embodiment is formed similarly to the floating connector 10D of the fifth embodiment except for the stub members 130E, the fixed housing 150E and the movable housing 160E.

As shown in FIG. 25, in the floating connector 10E of the present embodiment, the stub member 130E has a shape similar to an upside-down shape of the stub member 1308 of the third embodiment. In other words, each of the stub members 130E has a held portion (a second held portion) 132, a supporting portion 136 and a stub contact point 138.

As shown in FIG. 25, the movable housing 160E does not have the second holding portions 172D that the movable housing 160D has. On the other hand, the fixed housing 150E has second holding portions 172E. The second holding portions 172E hold the held portions 132 of the stub members 130E.

As shown in FIG. 25, the stub contact point 138 of the stub member 130E is in contact with the third part 128 of the contact 100D corresponding thereto. The supporting portion 136 of the stub member 130E is resiliently deformable, and thereby the stub contact point 138 is movable at least in the lateral direction. In the present embodiment, the stub contact point 138 is always pressed against the third part 128 due to resilient deformation of the supporting portion 136.

In the floating connector 10E according to the present embodiment, the stub member 130E is always electrically connected to the contact 100D corresponding thereto though the stub contact point 138. Accordingly, an impedance of the contact 100D can be reduced without providing a wide adjustment portion to the contact 100D.

Seventh Embodiment

Figure 26:
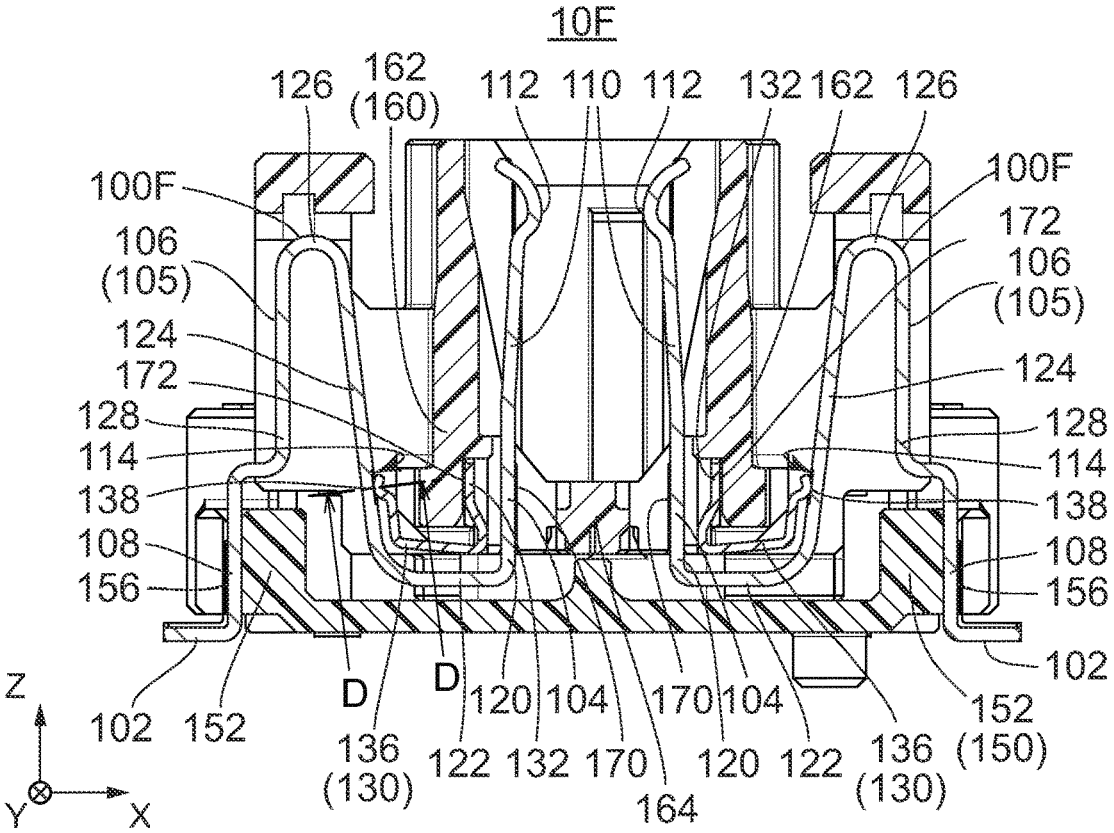
FIG. 26 is a cross-sectional view showing a floating connector according to a seventh embodiment of the present invention. A position of the cross section corresponds to that of the line A-A of FIG. 1.
Figure 27:
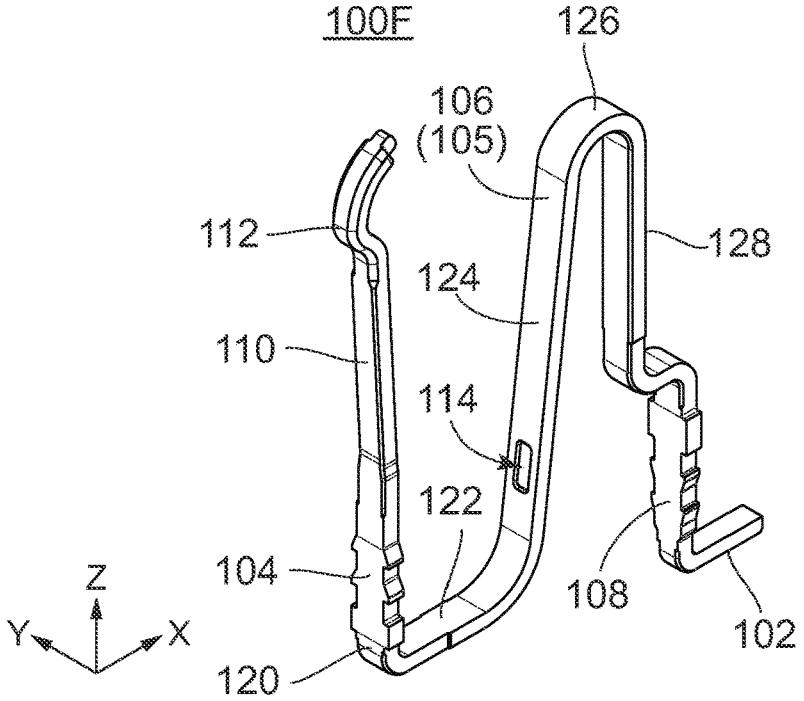
FIG. 27 is a perspective view showing a contact of a first row included in the floating connector of FIG. 26.

Referring to FIG. 26, a floating connector 10F according to a seventh embodiment of the present invention is formed to be the generally same as the floating connector 10 according to the first embodiment. However, as shown in FIG. 27, the contact 100F of the floating connector 10F of the present embodiment is different from the contact 100 of the first embodiment in a point that a dent portion 114 is formed.

Figure 28:
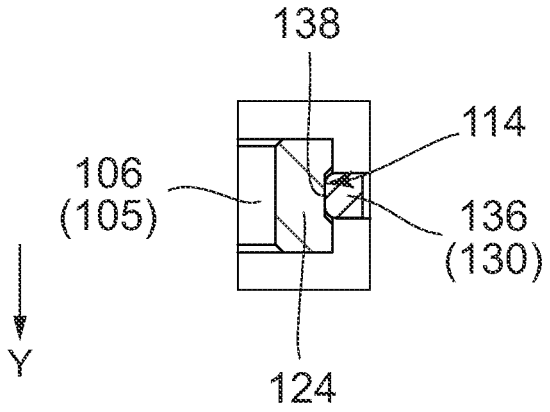
FIG. 28 is a partial, cross-sectional view showing the floating connector of FIG. 26, taken along line D-D.
Figure 29:
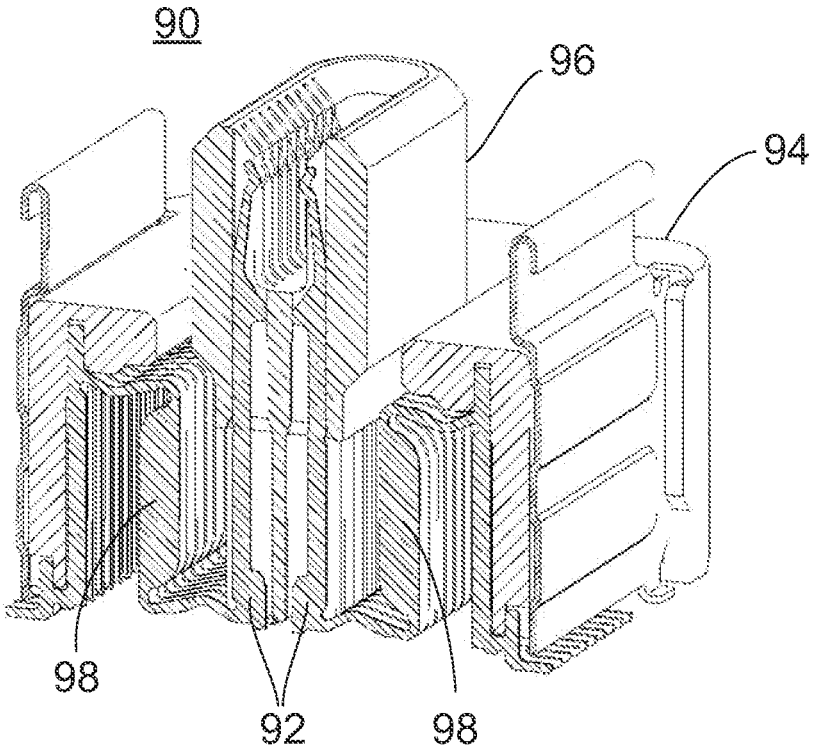
FIG. 29 PRIOR ART
FIG. 29 is a perspective view showing a floating connector disclosed in Patent Document 1.

As understood from FIGS. 26 and 28, in the pitch direction, a size of the dent portion 114 of the contact 100F is larger than a size of the stub contact point 138. The stub contact point 138 of the stub member 130 is pressed against the contact 100F corresponding thereto in the dent portion 114 of the contact 100F.

In the floating connector 10F according to the present embodiment, the stub member 130 is always electrically connected to the contact 100F corresponding thereto through the stub contact point 138. In addition, since the stub contact point 138 is located in the dent portion 114, contact between the stub contact point 138 and the contact 100 is certainly maintained even when the movable housing 160 is moved in a relatively wide range with respect to the fixed housing 150. Accordingly, an impedance of the contact 100F can be reduced without providing a wide adjustment portion to the contact 100F.

Although the specific explanation about the present invention is made above with reference to the embodiments, the present invention is not limited thereto but susceptible of various modifications and alternative forms without departing from the spirit of the invention. For example, in each of the second, the third, the fifth and the seventh embodiments, the floating connector may be formed without using the fixed housing. Moreover, in each of the second to the seventh embodiments, the extension portion 110 of the contact may not be resiliently deformable. Furthermore, in each of the second to the seventh embodiments, the supporting portion 136 of the stub member may not be resiliently deformable provided that the stub contact point 138 is always pressed against the contact. Yet furthermore, in each of the first to the sixth embodiments, a dent portion 114 may be formed in the contact. Still furthermore, the structure that the stub member 1308 is pressed against the first part 120 in the third embodiment is applicable to a tall-type floating connector like that shown in FIG. 23.

Transmission characteristics of the floating connector according to each of the embodiments described above depend on a contact position between the stub contact point 138 and the contact and on a length of the supporting portion 136 of the stub member. Accordingly, in an actual floating connector, selection of an appropriate shape of the stub member and setting a position and a size of each part should be carried out according to required transmission characteristics.

Moreover, in each of the embodiments described above, the stub members are provided to correspond to all of the contacts in one-to-one correspondence. However, the present invention is not limited thereto. A stub member(s) may be provided to correspond to only a specified contact(s), e.g. a high-speed contact(s). For example, when the specified contact is one in number, one stub member is provided to correspond to the specified contact. Moreover, when the specified contacts are two in number, two stub members are provided to correspond to the specified contacts in one-to-one correspondence. Furthermore, when the specified contacts are six in number, six stub members are provided to correspond to the specified contacts in one-to-one correspondence. In other words, in the present invention, at least one stub member 130 should be provided to correspond to at least one contact 100 in one-to-one correspondence.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A floating connector which is mountable on a substrate and which is mateable with and removable from a mating connector having a mating contact portion along an up-down direction, wherein:

the floating connector comprises a plurality of contacts, at least one stub member, and a movable housing;

the movable housing has a first holding portion and a second holding portion;

each of the contacts has a fixed portion fixable to the substrate, a first held portion held by the first holding portion, a coupling portion coupling the fixed portion and the first held portion with each other, an extension portion extending upward from the first held portion, and a contact portion supported by the extension portion;

the contact portion comes into contact with the mating contact portion when the floating connector is mated with the mating connector;

the coupling portion is resiliently deformable and thereby the movable housing is movable within a predetermined range in a plane perpendicular to the up-down direction;

the at least one stub member corresponds to at least one of the contacts in one- to-one correspondence;

the stub member has a second held portion held by the second holding portion, a supporting portion extending from the second held portion, and a stub contact point supported by the supporting portion; and the stub contact point is always pressed against the coupling portion of the contact corresponding to the stub member even when the movable housing is moved within the predetermined range.

2. The floating connector as recited in claim 1, wherein the supporting portion of the stub member is resiliently deformable and always presses the stub contact point against the coupling portion of the connector corresponding to the stub member.

3. The floating connector as recited in claim 1, wherein:

the contacts are arranged in a pitch direction perpendicular to the up-down direction; and the stub contact point of the stub member and the coupling portion of the contact corresponding to the stub member are located so as always to overlap with each other in the pitch direction.

4. The floating connector as recited in claim 1, wherein each of the contacts is made by stamping and bending a metal sheet.

5. The floating connector as recited in claim 1, wherein:

the contacts are arranged in a pitch direction perpendicular to the up-down direction;

the coupling portion has a first part extending downward from the first held portion, a first folded portion located at a lower end of the first part, a second part extending upward from the first folded portion, a second folded portion located at an upper end of the second part, and a third part extending from the second folded portion to the fixed portion; and the stub contact point is located between the first part of the contact corresponding to the sub member and the second part of the contact corresponding to the sub member in a lateral direction perpendicular to both of the up-down direction and the pitch direction and pressed against the second part.

6. The floating connector as recited in claim 1, wherein:

the contacts are arranged in a pitch direction perpendicular to the up-down direction;

the coupling portion has a first part extending downward from the first held portion and a conversion portion extending from a lower end of the first part toward the fixed portion along a lateral direction perpendicular to both of the up-down direction and the pitch direction; and the stub contact point is located upward of the conversion portion in the up-down direction and pressed against the conversion portion.

7. The floating connector as recited in claim 6, wherein the coupling portion further has a second part extending upward from the conversion portion, a second folded portion located at an upper end of the second part, and a third part extending from the second folded portion to the fixed portion.

8. The floating connector as recited in claim 6, wherein the coupling portion further has a third part extending downward from a tip of the conversion portion to the fixed portion.

9. The floating connector as recited in claim 1, wherein:

the contacts are arranged in a pitch direction perpendicular to the up-down direction;

the coupling portion has a first part extending downward from the first held portion; and the stub contact point is pressed against the first held portion of the contact corresponding to the stub member or the first part of the contact corresponding to the stub member in a lateral direction perpendicular to the both of the up-down direction and the pitch direction.

10. The floating connector as recited in claim 1, wherein:

each of the contacts includes a dent portion; and the stub contact point is pressed against the contact corresponding to the stub member in the dent portion of the contact.

11. The floating connector as recited in claim 10, wherein:

the contacts are arranged in a pitch direction perpendicular to the up-down direction; and a size of the dent portion is larger than a size of the stub contact point in the pitch direction.

12. A floating connector which is mountable on a substrate and which is mateable with and removable from a mating connector having a mating contact portion, wherein:

the floating connector comprises a plurality of contacts, at least one stub member, a fixed housing, and a movable housing;

the movable housing has a first holding portion;

the fixed housing has a second holding portion and a third holding portion;

each of the contacts has a fixed portion fixable to the substrate, a third held portion held by the third holding portion, a first held portion held by the first holding portion, a deformable portion coupling the first held portion and the third held portion with each other, an extension portion extending upward from the first held portion, and a contact portion supported by the extension portion;

the contact portion comes into contact with the mating contact portion when the floating connector is mated with the mating connector;

the deformable portion is deformable and thereby the movable housing is movable within a predetermined range in a plane perpendicular to the up-down direction;

the at least one stub member corresponds to at least one of the contacts in one- to-one correspondence;

the stub member has a second held portion held by the second holding portion, a supporting portion extending from the second held portion, and a stub contact point supported by the supporting portion; and the stub contact point is always pressed against the deformable portion of the contact corresponding to the stub member even when the movable housing is moved within the predetermined range.

13. The floating connector as recited in claim 12, wherein the supporting portion of the stub member is resiliently deformable and always presses the stub contact point against the deformable portion of the connector corresponding to the stub member.

14. The floating connector as recited in claim 12, wherein:

the contacts are arranged in a pitch direction perpendicular to the up-down direction; and the stub contact point of the stub member and the deformable portion of the contact corresponding to the stub member are located so as always to overlap with each other in the pitch direction.

15. The floating connector as recited in claim 12, wherein:

the contacts are arranged in a pitch direction perpendicular to the up-down direction;

the deformable portion has a first part extending downward from the first held portion, a first folded portion located at a lower end of the first part, a second part extending upward from the first folded portion, a second folded portion located at an upper end of the second part, and a third part extending from the second folded portion to the third held portion; and the stub contact point is located between the second part of the contact corresponding to the stub member and the third part of the contact corresponding to the stub member in a lateral direction perpendicular to both of the up-down direction and the pitch direction and pressed against the second part.

16. The floating connector as recited in claim 12, wherein:

the contacts are arranged in a pitch direction perpendicular to the up-down direction;

the deformable portion has a first part extending downward from the first held portion, a conversion portion extending from a lower end of the first part toward the fixed portion along a lateral direction perpendicular to both of the up-down direction and the pitch direction, and a third part extending downward from a tip of the conversion portion to the fixed portion; and the stub contact point is pressed against the third part of the contact corresponding to the stub member.

* * * * *